US012246234B1

(12) United States Patent
Olsen

(10) Patent No.: US 12,246,234 B1
(45) Date of Patent: Mar. 11, 2025

(54) MOVEABLE HEAVY BAG STAND

(71) Applicant: Grant Douglas Olsen, Phoenix, AZ (US)

(72) Inventor: Grant Douglas Olsen, Phoenix, AZ (US)

( * ) Notice: Subject to any disclaimer, the term of this patent is extended or adjusted under 35 U.S.C. 154(b) by 0 days.

(21) Appl. No.: 18/748,197

(22) Filed: Jun. 20, 2024

Related U.S. Application Data

(60) Provisional application No. 63/625,070, filed on Jan. 25, 2024, provisional application No. 63/621,254, filed on Jan. 16, 2024.

(51) Int. Cl.

| | |
|---|---|
| ***A63B 69/20*** | (2006.01) |
| ***A63B 69/22*** | (2006.01) |
| ***A63B 69/28*** | (2006.01) |
| ***A63B 71/00*** | (2006.01) |

(52) U.S. Cl.
CPC ..... *A63B 69/305* (2022.08); *A63B 69/22* (2022.08); *A63B 69/28* (2022.08); *A63B 71/0036* (2013.01); *A63B 2210/50* (2013.01); *A63B 2225/093* (2013.01)

(58) Field of Classification Search
CPC ..... A63B 69/22; A63B 69/305; A63B 69/28; A63B 71/0036; A63B 2210/50; A63B 2225/093; F16M 2200/00; F16M 11/20; E04C 3/005
See application file for complete search history.

(56) References Cited

U.S. PATENT DOCUMENTS

| | | | | |
|---|---|---|---|---|
| 5,863,278 | A * | 1/1999 | Chen | A63B 69/222 482/90 |
| 6,186,926 | B1 * | 2/2001 | Ellis | A63B 23/0211 482/137 |
| 6,719,566 | B2 * | 4/2004 | Farenholtz | G09B 23/30 482/133 |
| 7,458,919 | B2 * | 12/2008 | Giusti | A63B 69/222 482/87 |
| 7,922,628 | B2 * | 4/2011 | Gonzalez | A63B 69/22 482/90 |
| 8,574,101 | B2 * | 11/2013 | Wheelbarger | A63B 69/22 473/422 |
| 9,925,447 | B2 * | 3/2018 | Hajnasr | A63B 69/28 |
| 2005/0250624 | A1 * | 11/2005 | Yu | A61H 3/008 482/69 |
| 2006/0025285 | A1 * | 2/2006 | Giusti | A63B 69/222 482/90 |
| 2008/0220949 | A1 * | 9/2008 | Yang | A63B 69/222 482/90 |

OTHER PUBLICATIONS

Walmart website, "Fuel Pureformance Heavy Bag Stand." https://www.walmart.com/ip/Fuel-Pureformance-Heavy-Bag-Stand-Black/55505439. Accessed Nov. 16, 2023.

(Continued)

*Primary Examiner* — Megan Anderson
(74) *Attorney, Agent, or Firm* — Meister Seelig & Fein PLLC

(57) ABSTRACT

A bag stand, including a base comprising two or more legs, one or more wheels attached to each of the two or more legs, a support bracket disposed at an intersection of the two or more legs, the support bracket attaching an arm to the two or more legs, and a bag support disposed at a distal end of the arm.

42 Claims, 23 Drawing Sheets

(56) References Cited

OTHER PUBLICATIONS

Vevor website, "Vevor 2 in 1 Heavy Bag Stand." https://www.vevor.com/heavy-bag-stand-c_11544/folding-boxing-bag-stand-with-pull-up-bar-2in1-set-height-adjustable-push-ups-p_010860995519?adp=gmc&utm_id=11694817580&gad_source=1. Accessed Nov. 16, 2023.
Amazon website, "Vivohome Heigh adjustable foldable heavy duty boxing punching stand steel sandbag rack." https://www.amazon.com/VIVOHOME-Adjusttable-Foldable-Punching-Freestanding/dp/B091CCLC7G.

* cited by examiner

MOVEABLE HEAVY BAG STAND

CROSS-REFERENCE TO RELATED APPLICATIONS

This application claims priority under 35 U.S.C. § 120 from U.S. Provisional application No. 63/621,254, filed on Jan. 16, 2024 in the United States Patent and Trademark Office, and U.S. Provisional application No. 63/625,070, filed on Jan. 25, 2024 in the United States Patent and Trademark Office, the disclosures of which are incorporated herein in their entirety by reference.

BACKGROUND

Punching bags are large, heavy bags made to absorb impacts, for example from punches of a user practicing boxing or martial arts. These bags must be supported, either suspended from a hook or resting on a stand. These supports must be built strongly to hold not just the weight of the punching bag, but to absorb the motion of the punching bag as it is used. As a result, many punching bag supports are permanently installed into a wall, floor, or ceiling. Conversely, mobile punching bag supports necessarily are not secured to any solid anchor point, and so may wobble or fall over while the punching bag is being used. A mobile bag support must therefore be weighed down. There are three types of mobile bags. In the first type, the punching bag sits atop a support such as a stand that itself contains water or sand. In the second type, the bag hangs from a post acting as the support, such that the bag is suspended in the air. This second type is typically weighted down with sandbags or other types of weights placed over or straddling the support's legs where they contact the ground. Placed in this manner, these weights may restrict access to the punching bag while in use and may also trip a user. For these two types of mobile bags, the weighted elements must be taken away and relocated if the support is ever moved, thus adding complications to moving a mobile bag support to any new location. In the third type of stand, no additional weights are required, but the base itself is both broad and heavy, thereby also complicating and making difficult the movement of the bag support to a new location. The end effect of this is that while some existing conventional stands may technically be mobile, moving these stands is not a simple process.

Conventional mobile bag supports may also keep a bag close to the hardware supporting the weight of the bag, such that the bag may sometimes rest against part of the support when in use. As such, components of the support itself may interfere with access to the bag or the motion of the bag. Furthermore, the bag may block access to the support, preventing the user from adjusting the support without removing the heavy bag first.

There is therefore a need for a heavy bag support stand that addresses at least some of the above concerns.

SUMMARY OF THE INVENTION

Exemplary embodiments of the present general inventive concept may provide a heavy bag stand and methods of making the same.

The foregoing and/or other features and utilities of the present general inventive concept may be achieved by providing a bag stand, the bag stand including a base comprising two or more legs, a support bracket disposed at an intersection of the two or more legs, the support bracket attaching an arm to the two or more legs, one or more wheels attached to each of the two or more legs, and a bag support disposed at a distal end of the arm.

In an exemplary embodiment, the support bracket may further include a foot, the foot being configured to fit inside the arm to attach the arm to the two or more legs.

In an exemplary embodiment, the bag stand may further include a counterweight disposed at one side of the base, the counterweight comprising an anchor point, one or more weights attached to the anchor point, at least one spacer configured to separate the one or more weights from the base, and at least one pad configured to support the one or more weights on the at least one spacer.

In an exemplary embodiment, the arm may be angled away from the counterweight.

In an exemplary embodiment, the bag stand may further include a first brace disposed between two or more of the legs, and a second brace disposed on the first brace and connected to the arm, the second brace forming an angle with the arm.

In an exemplary embodiment, the first brace may include a supporting tube configured to fit into and support the second brace.

In an exemplary embodiment, the bag stand may further include at least one side brace attached to one of the legs, each side brace comprising a main bar extending substantially perpendicularly away from the leg.

In an exemplary embodiment, the at least one side brace may further include a wheel.

In an exemplary embodiment, the bag stand may further include a tether strap configured to restrict the movement of a bag suspended from the bag support, such that the bag is prevented from swinging beyond a predefined point.

In an exemplary embodiment, the bag stand may further include a bag restraint, the bag restraint comprising a strap attached to the arm, the strap configured to secure a bag suspended from the bag support such that the bag is held against the arm.

In an exemplary embodiment, the bag stand may further include a speedbag attachment.

In an exemplary embodiment, the bag stand may further include at least one side strut disposed substantially parallel to the arm, the side strut including a first anchor point disposed on the arm and a second anchor point disposed on the base.

In an exemplary embodiment, each of the one or more wheels may further include a wheel lock configured to move between an engaged state in which the wheel lock limits movement of the wheel, and a disengaged state in which the wheel lock does no limit movement of the wheel.

In an exemplary embodiment, the wheel lock may include a lever configured to apply friction to the wheel when the wheel lock is in the engaged state.

In an exemplary embodiment, each of the one or more wheels may further include a foot, the foot being configured to contact the ground when the wheel lock is in the engaged state, and to not contact the ground when the wheel lock is in the disengaged state.

The foregoing and/or other features and utilities of the present general inventive concept may be achieved by providing a bag stand, the bag stand including a base including two or more legs, and at least one side brace attached to one of the legs, the side brace including a main bar having a second thickness, an upper plate attached to one face of the main bar, a first end of the upper plate extending beyond an end of the main bar, a lower plate attached to a face of the main bar opposite the upper plate, a first end of the lower plate extending beyond the end of the main bar, wherein the first end of the upper plate and the first end of the lower plate define a distance between them about equal to the first thickness, wherein the upper plate and the lower plate are configured to be attached to the at least one leg, such that the main bar is substantially perpendicular to the at least one leg and extends away from the at least one leg.

Additional features and utilities of the present general inventive concept will be set forth in part in the description which follows and, in part, will be obvious from the description, or may be learned by practice of the general inventive concept.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF EXEMPLARY EMBODIMENTS OF THE INVENTIVE CONCEPT

Figure 1A:
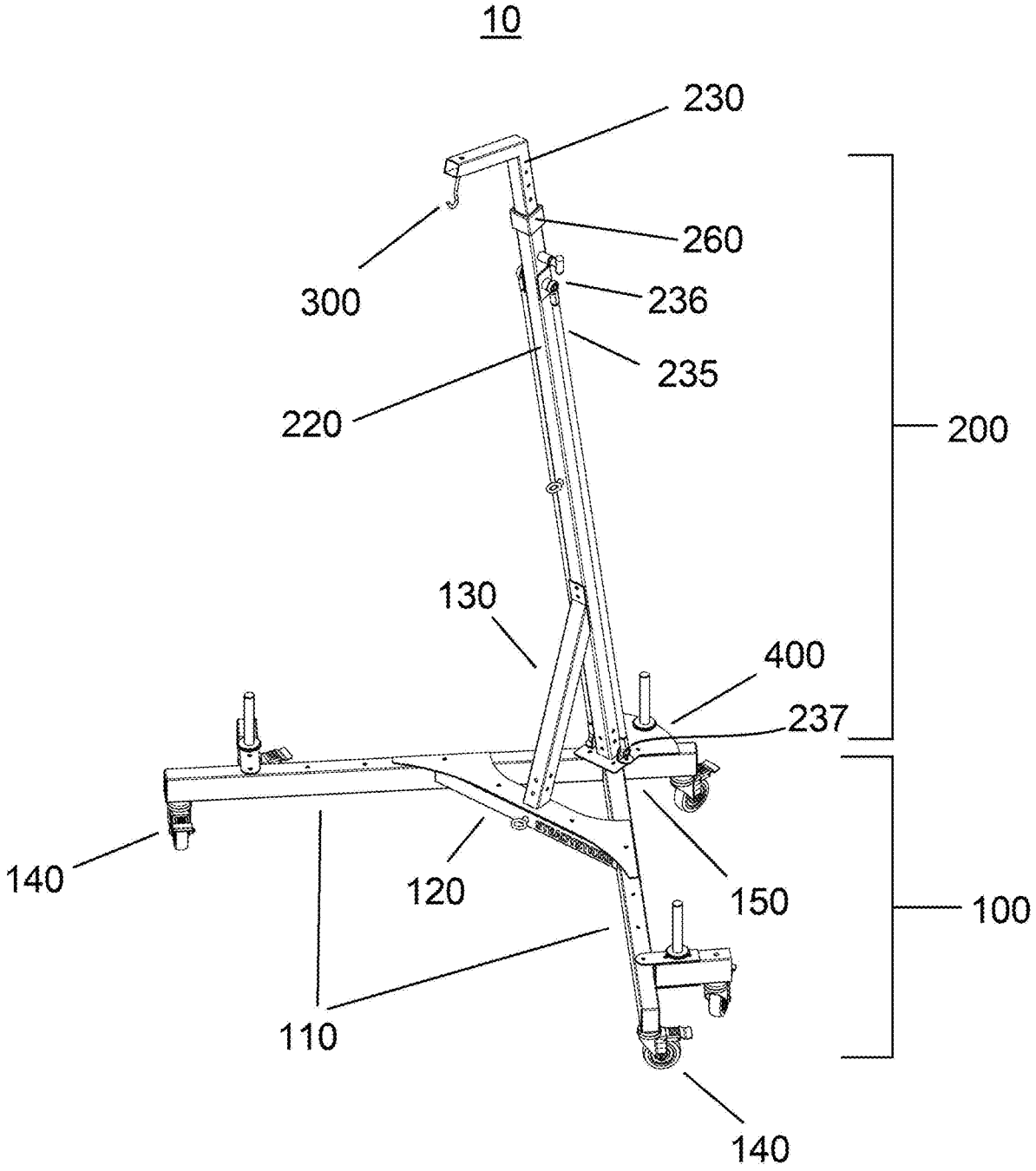
FIG. 1A illustrates a front perspective view of a mobile heavy bag stand according to an exemplary embodiment of the present general inventive concept.
Figure 1B:
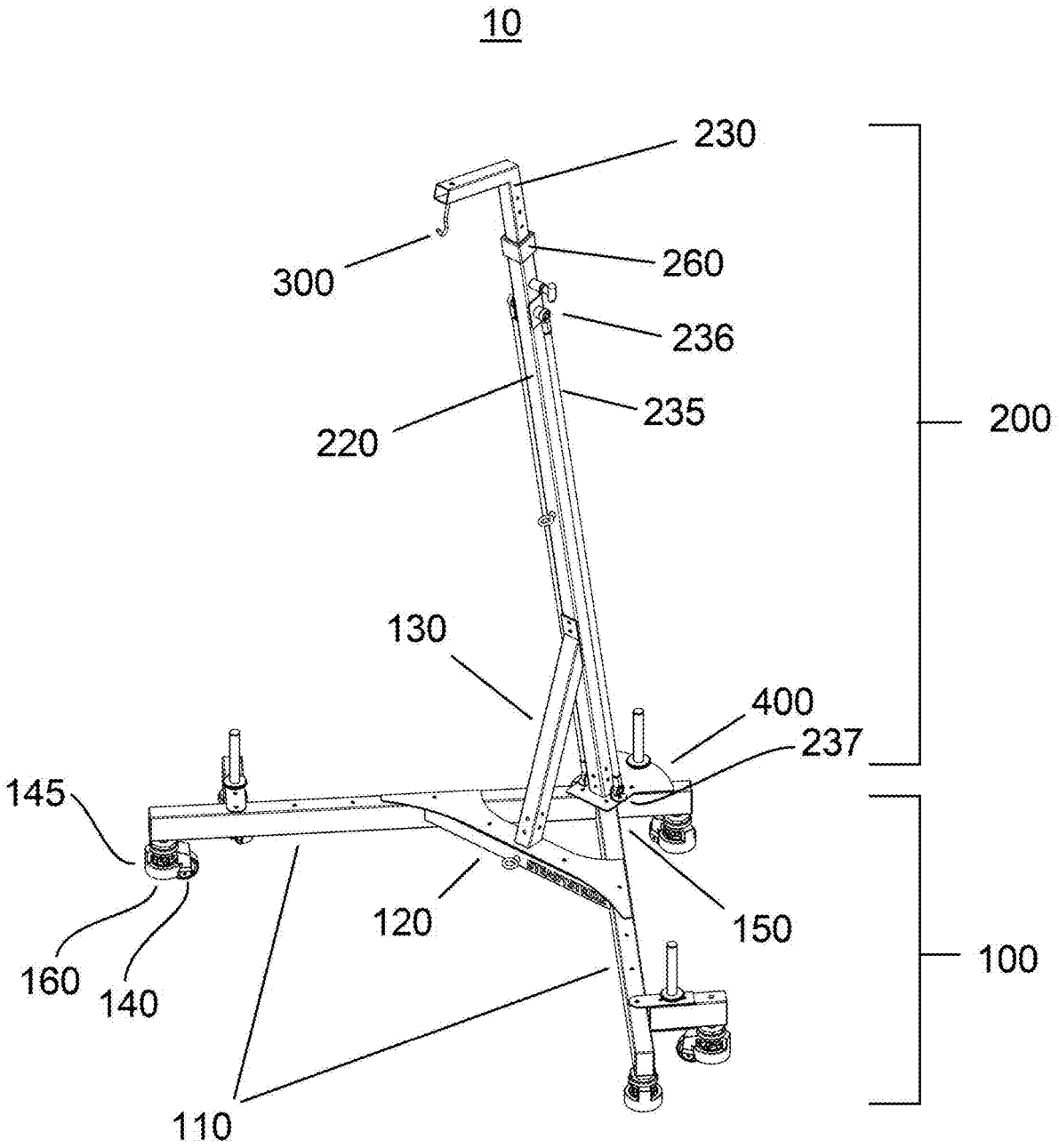
FIG. 1B illustrates a front perspective view of a mobile heavy bag stand according to another exemplary embodiment of the present general inventive concept.

Reference will now be made in detail to embodiments of the present general inventive concept, examples of which are illustrated in the accompanying drawings, wherein like reference numerals refer to the like elements throughout. The embodiments are described below in order to explain the present general inventive concept while referring to the figures. Also, while describing the present general inventive concept, detailed descriptions about related well-known functions or configurations that may diminish the clarity of the points of the present general inventive concept are omitted.

Expressions such as "at least one of," when preceding a list of elements, modify the entire list of elements and do not modify the individual elements of the list.

All terms including descriptive or technical terms which are used herein should be construed as having meanings that are obvious to one of ordinary skill in the art. However, certain terms may have different meanings according to an intention of one of ordinary skill in the art, case precedents, or the appearance of new technologies. Also, some terms may be arbitrarily selected by the applicant, and in this case, the meaning of the selected terms will be described in detail in the detailed description of the invention. Thus, the terms used herein have to be defined based on the meaning of the terms together with the description throughout the specification.

Also, when a part "includes" or "comprises" an element, unless there is a particular description contrary thereto, the part can further include other elements, not excluding the other elements.

Hereinafter, one or more exemplary embodiments of the present general inventive concept will be described in detail with reference to accompanying drawings.

FIG. 1A illustrates a mobile bag stand 10 according to an exemplary embodiment of the present general inventive concept. As illustrated therein, the mobile bag stand 10 may include a base 100 including two or more legs 110, an arm 200, and a bag support 300 disposed at the end of the arm 200.

Figure 5B:
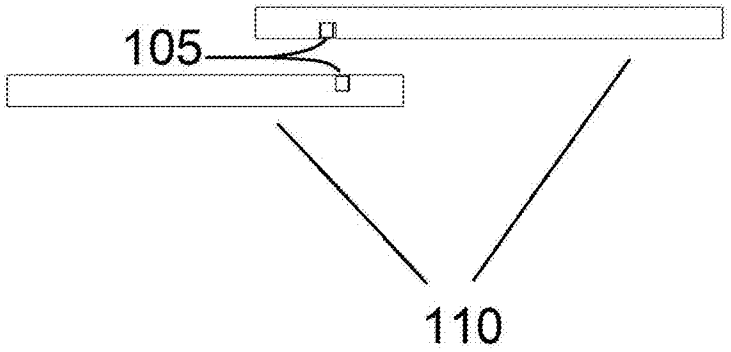
FIG. 5B illustrates an exploded front plan view of legs of a mobile heavy bag stand according to an exemplary embodiment of the present general inventive concept.
Figure 5A:
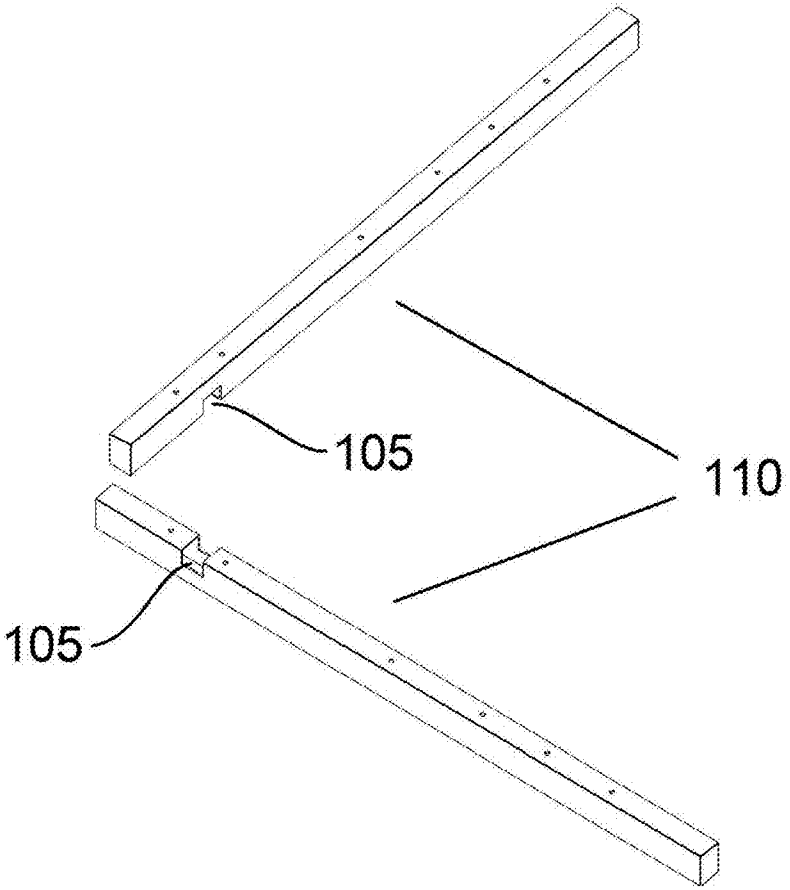
FIG. 5A illustrates an exploded front perspective view of legs of a mobile heavy bag stand according to an exemplary embodiment of the present general inventive concept.

According to an exemplary embodiment of the present general inventive concept, two or more legs 110 may intersect to form the base 100 of the mobile bag stand 10. The legs 110 may be affixed together at their intersection, for example with screws, bolts, glue, welds, etc. According to an exemplary embodiment of the present general inventive concept, the legs 110 may include complementary notches 105, such that they may interlock together at a predefined intersection. Exemplary embodiments of these notches 105 are illustrated in FIGS. 5A-5B. FIG. 5A illustrates an exploded front perspective view of legs 110 of a mobile heavy bag stand 10 according to an exemplary embodiment of the present general inventive concept. FIG. 5B illustrates an exploded front plan view of legs 110 of a mobile heavy bag stand 10 according to an exemplary embodiment of the present general inventive concept.

A foot 210 of the arm 200 (illustrated in FIGS. 4 and 6A-B) may be located at the intersection of the legs 110, such that the arm 200 is attached to the legs 110 at the intersection. According to exemplary embodiments of the present general inventive concept, legs 110 and foot 210 may be connected to a support bracket 150 disposed at the intersection of the legs 110.

As illustrated in FIGS. 1A-D, a counterweight 400 may be located behind the foot 210 of the arm 200. According to exemplary embodiments of the present general inventive concept, two or more of the legs 110 may define an area behind the arm 200 where the counterweight 400 may be located, and the counterweight 400 may be located between two or more of the legs 110. The counterweight 400 may serve to counterbalance the weight of a bag 20 hanging from the bag support 300 (illustrated in FIGS. 10A-10B, 11A-11B, and 12A).

Figure 3A:
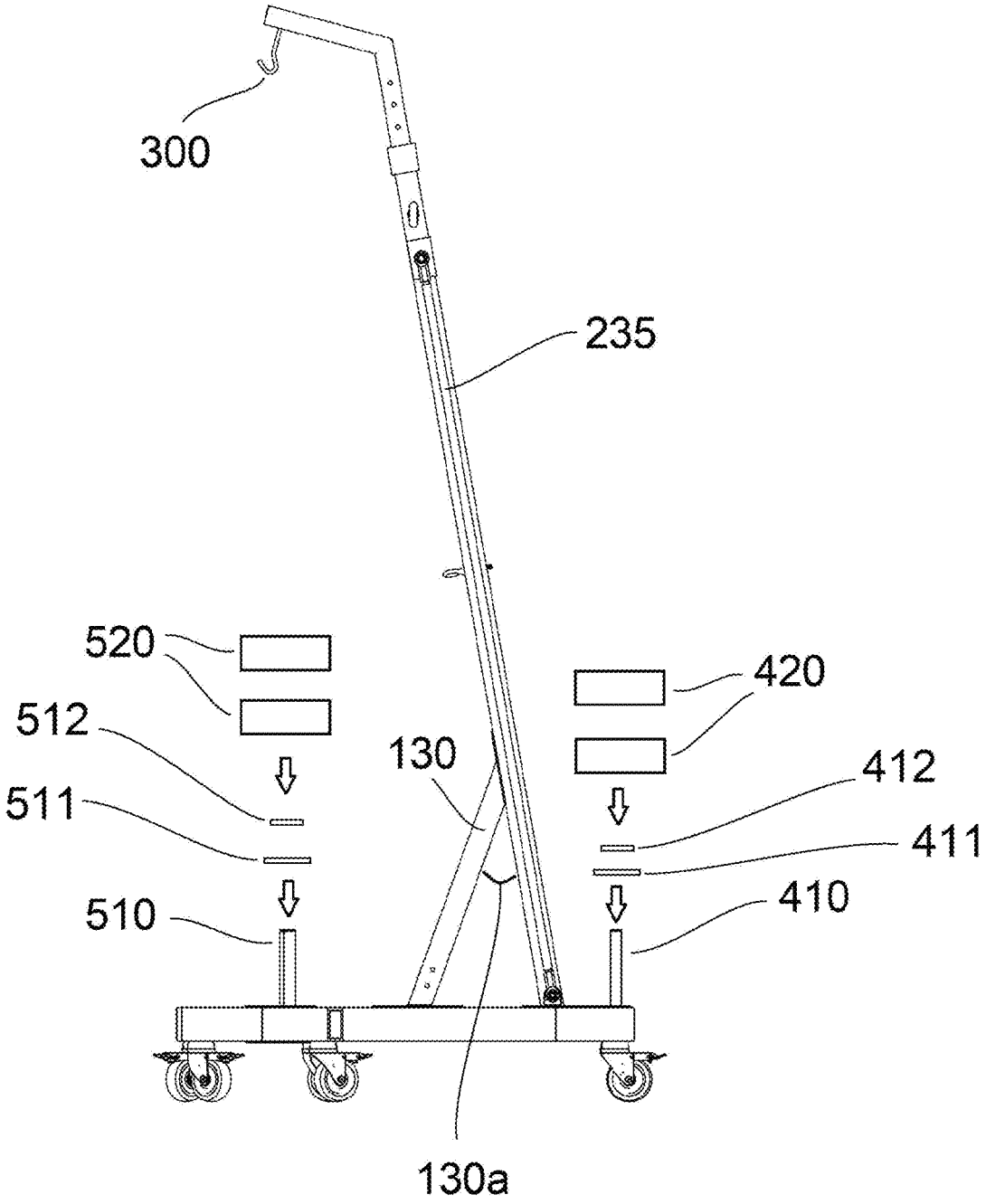
FIG. 3A illustrates a side elevation view of a mobile heavy bag stand according to an exemplary embodiment of the present general inventive concept.
Figure 3B:
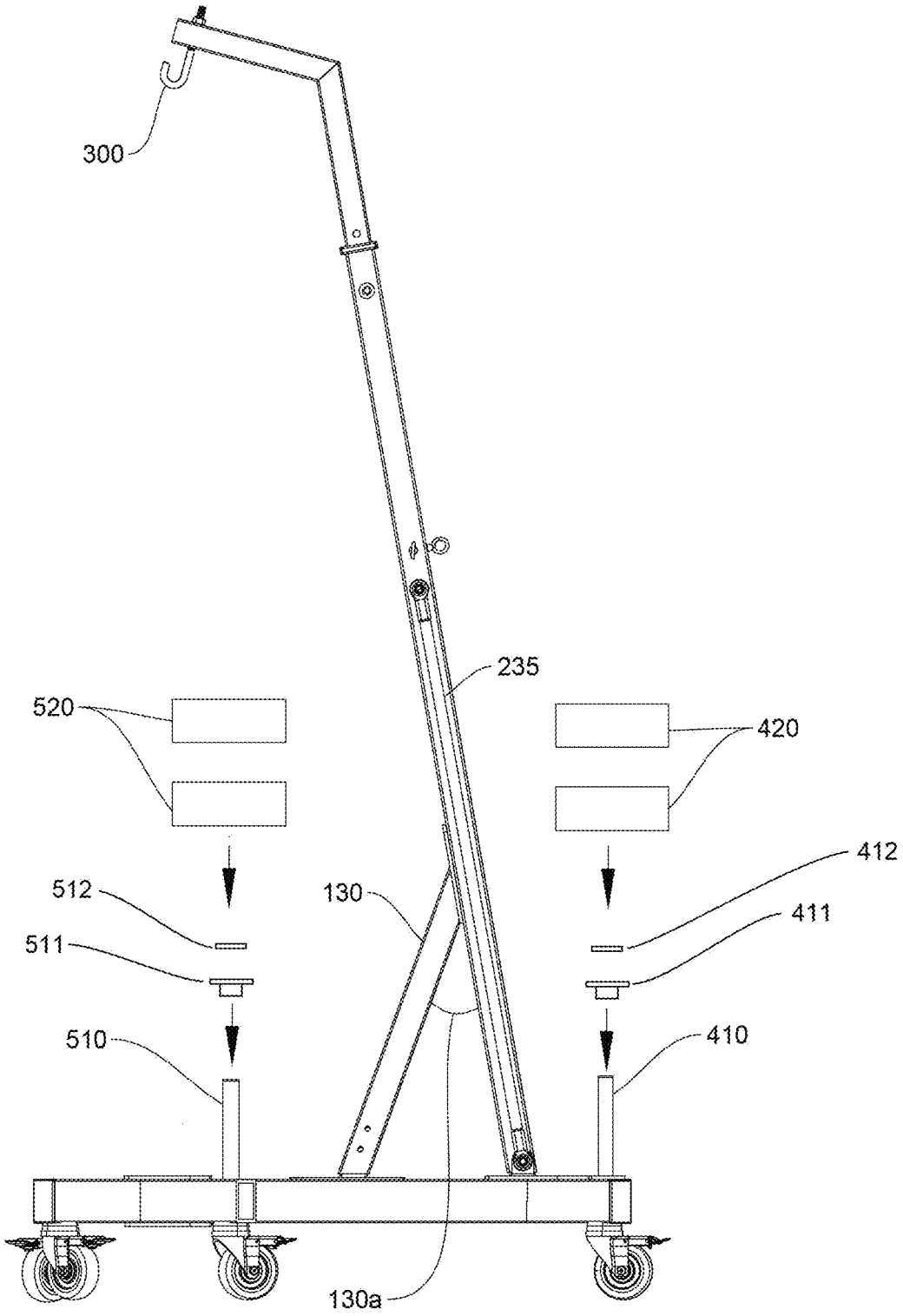
FIG. 3B illustrates a side elevation view of a mobile heavy bag stand according to an exemplary embodiment of the present general inventive concept.

According to exemplary embodiments of the present general inventive concept, the counterweight 400 may comprise an anchor point 410 and one or more weights 420 affixed to the anchor point 410, which may be configured to support the weight(s) 420 on the stand 10. An exemplary embodiment of weights 420 is illustrated in FIGS. 3A and 3B. The weight(s) 420 are omitted in the other drawings for clarity. According to an exemplary embodiment of the present general inventive concept, the anchor point 410 may be a post or a tube which may fit through a hole disposed in each weight 420, for example if the weight(s) 420 are a classic round "donut" shape with a hole at the center. According to other exemplary embodiments of the present general inventive concept, the anchor point 410 may be a tray or plate configured to hold weights 420.

Figure 9:
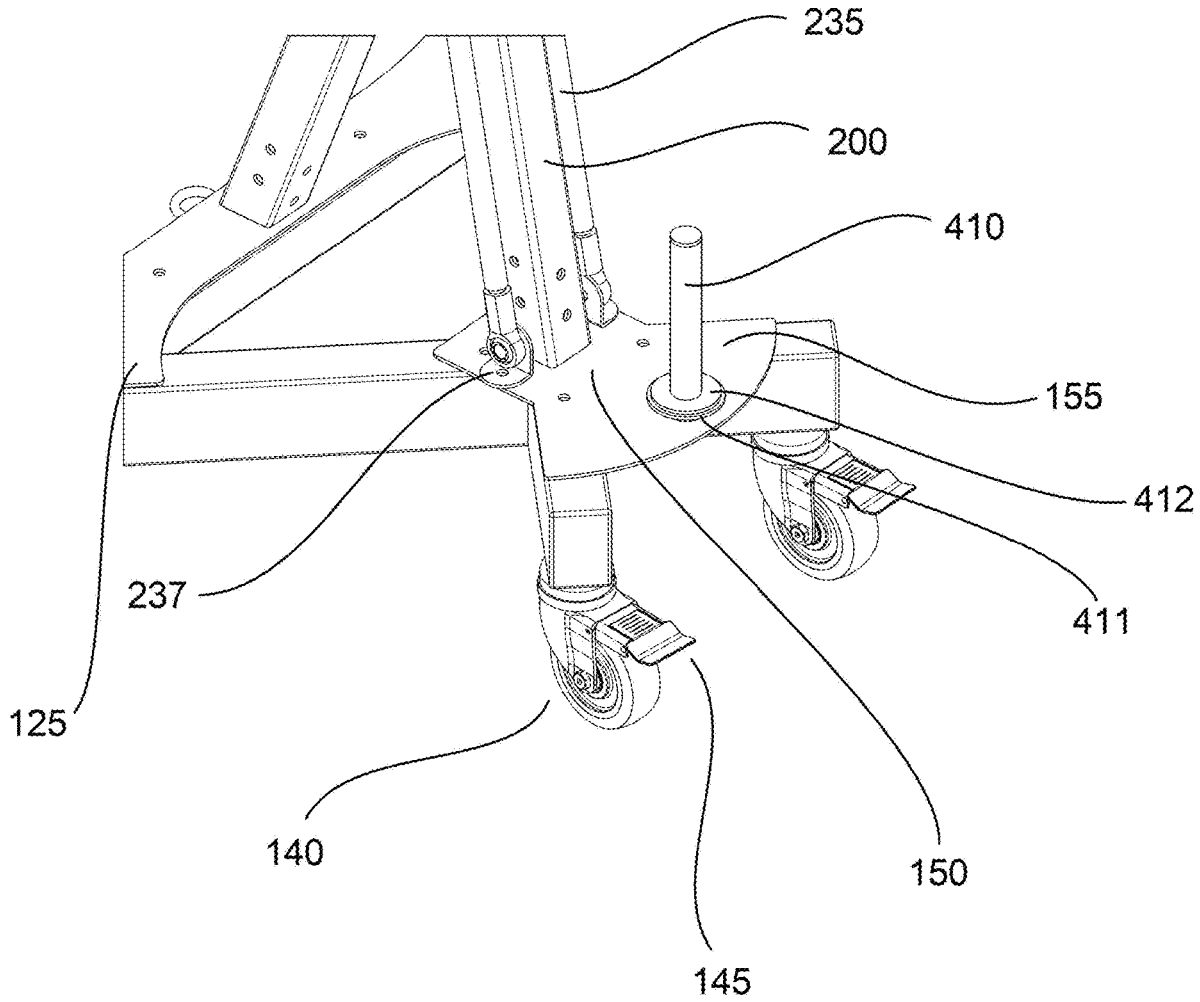
FIG. 9 illustrates a support bracket of a mobile heavy bag stand according to an exemplary embodiment of the present general inventive concept.

According to exemplary embodiments of the present general inventive concept, the anchor point 410 may include a spacer 411 and a pad 412 (illustrated in FIG. 9, and illustrated with size exaggerated for clarity in FIGS. 3A and 3B). The spacer 411 may separate weight(s) 420 from the rest of the base 100. According to exemplary embodiments of the present general inventive concept, the spacer 411 may be one or more of a hollow tube, one or more metal washers, or other structure. According to the exemplary embodiment illustrated in FIG. 3A, the spacer 411 may be a washer. According to the exemplary embodiment illustrated in FIG. 3B, the spacer 411 may be a washer attached to a length of tube which may fit over the anchor point 410. According to other exemplary embodiments of the present general inventive concept, the spacer 411 may be a mechanical method of separating the weight(s) 420 from the base 100, for example welding. The pad 412 may be, for example, a rubber washer or similar flexible material, and may support the weight(s) 420 on top of the spacer 411. Separating the weight(s) 420 from the base 100 with the spacer 411 may prevent the weight(s) 420 from rubbing against any component of the stand 10, for example screws or bolts meant to hold the stand 10 together. Furthermore, supporting the weight(s) 420 on the pad 412 may reduce the surface area of contact for the weight(s) 420, i.e., the weight(s) 420 may rest solely on the pad 412 and not on any other component of the stand 10, so that the force from weight(s) 420 remains focused around the anchor point 410. The pad 412 may also help dampen out any vibrations on the weight(s) 420 caused by the stand 10 being in use, i.e., by a user striking a bag 20 suspended from the bag support 300.

Counterweight 400 allows a user to customize the balance of the stand 10 to a particular application by adjusting the number and size of weight(s) 420. For example, weights 420 may add stability to keep the stand 10 steady if the bag 20 swings too far over the base 100 during use, or if the user strikes the bag 20 in a resonant pattern, i.e., swings the bag 20 back and forth. According to other exemplary embodiments of the present general inventive concept, the weight(s) 420 or counterweight 400 may be omitted, for example if the total weight and configuration of the legs 110, including the length and design of the legs 110, is enough to counterbalance the bag 20 hanging from the bag support 300.

Figure 4:
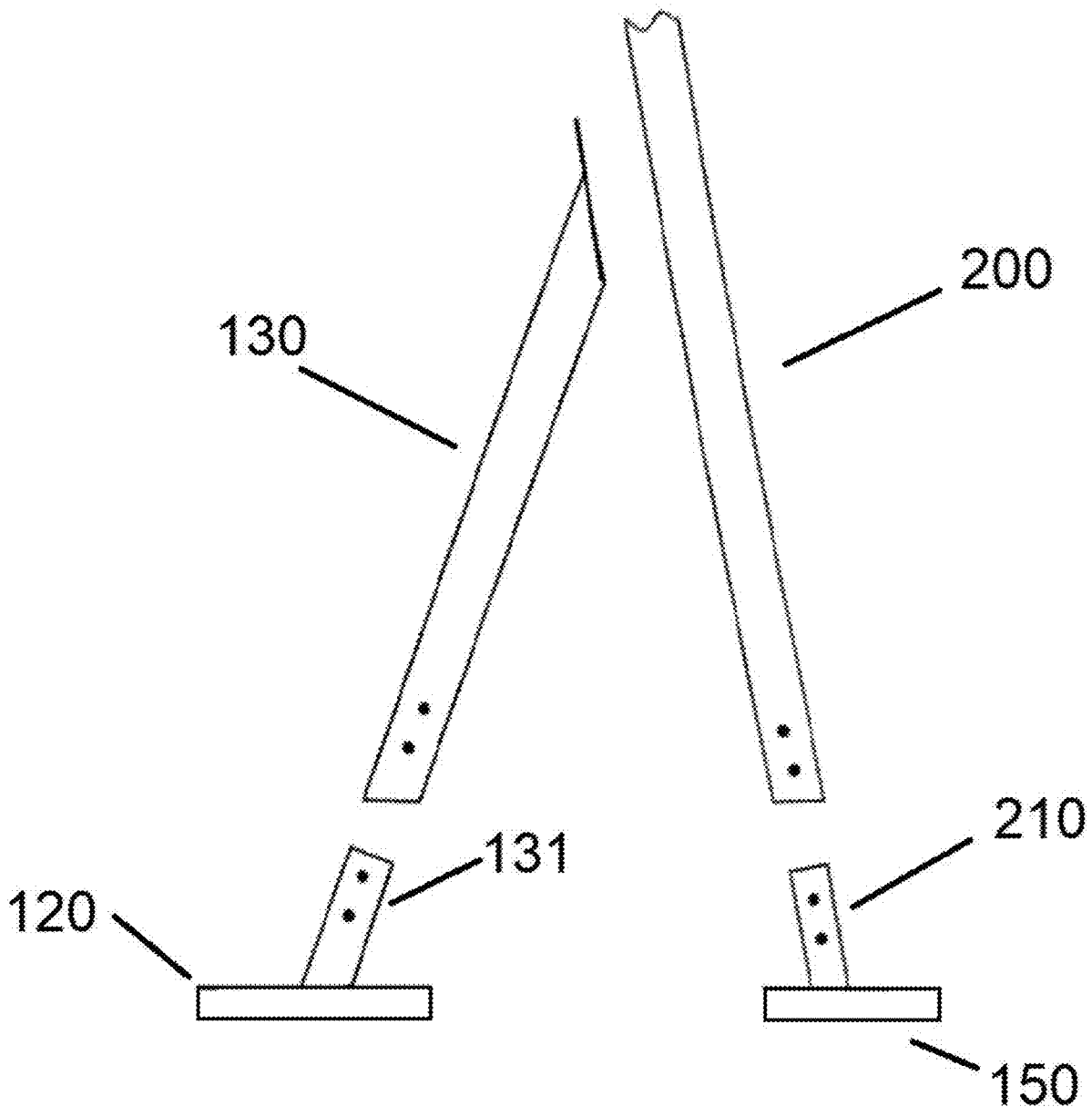
FIG. 4 illustrates an exploded side elevation view of an arm, first and second braces, and a support bracket of a mobile heavy bag stand according to an exemplary embodiment of the present general inventive concept.

The base 100 of the stand 10 may further include one or more braces to support the legs 110 and the arm 200. According to exemplary embodiments of the present general inventive concept, a first brace 120 may connect two or more of the legs 110. A second brace 130 may support the arm 200. As illustrated in FIG. 1A, according to exemplary embodiments of the present general inventive concept, second brace 130 may be supported on first brace 120. As illustrated in FIG. 4, the first brace 120 may further include a supporting tube 131 which may fit inside of the second brace 130, thereby stabilizing and supporting the second brace 130. Fitting the supporting tube 131 into the second brace 130 in this fashion may securely attach the second brace 130 to the first brace 120, as opposed to more conventional attachment methods, such as for example attaching the second brace 130 directly to the first brace 120 with screws or bolts. It will be understood that the arrangement of braces 120, 130 shown in FIG. 1A is an example, and that other exemplary embodiments of the present general inventive concept may include different braces.

As illustrated in FIG. 1A, according to an exemplary embodiment of the present general inventive concept, the first brace 120 may include ends that are angled to match an angle of the legs 110 attached thereto. For example, if the legs 110 are joined at a perpendicular intersection defining a 90-degree angle, each end of the first brace 120 may have a 45-degree angle to match the legs 110, as illustrated in FIG. 1A. The first brace 120 may further include side tabs 125 (illustrated in FIGS. 6A-6B and 9) disposed at either end of the first brace 120 to support the first brace 120 on the legs 110. Side tabs 125 may further serve as an attachment point to attach the first brace 120 to the legs 110, for example by drilling screws through the side tabs 125 and into the legs 110.

As illustrated in FIGS. 3A and 3B, the second brace 130 may form an angle 130*a* with the arm 200. According to exemplary embodiments of the present general inventive concept, the angle 130*a* formed between the second brace 130 and the arm 200 may be between about zero degrees and about 60 degrees. Furthermore, the ends of the second brace 130 may be angled to match the angles the second brace 130 makes with the arm 200 and the first brace 120, to ensure a flush fit between each end of the second brace 130, the first brace 120, and the arm 200.

According to exemplary embodiments of the present general inventive concept, the base 100 may further include one or more wheels 140. A wheel 140 may be positioned near the ends of each leg 110, as illustrated in FIG. 1. As such, the mobile bag stand 10 may be moved by a single user, who may move the stand 10 around on the wheels 140 without needing to lift the entire weight of the stand 10. Furthermore, if a user desires to move the stand 10, the counterweight 400, including any weights 420, does not need to be moved separately. According to exemplary embodiments of the present general inventive concept, the wheels 140 may support the bag 20, the stand 10, and any weights 420 while the stand 10 is being moved to a desired location on the wheels 140.

Exemplary embodiments of the present general inventive concept may include structural features to account for the wheels 140. The stand 10 may do more than simply support the bag 20 at rest. The stand 10 may remain stable when the bag 20 is struck from different sides. Furthermore, the stand 10 may withstand pendulum motion, or the bag 20 being moved back and forth during impacts, potentially in a resonant manner so that the bag 20 moves progressively more violently back and forth as it is struck. This issue is particularly acute for a stand 10 on wheels 140 for two reasons. First, the additional height of the wheels 140 raises the center of gravity of the stand 10. Second, on wheels 140 the weight of the stand 10 is supported on a limited number of points, as opposed to being distributed over the entire base 100. Accordingly, in exemplary embodiments of the present general inventive concept the legs 110 may be oriented to not only support the weight of the bag 20 at rest, but support the bag 20 when in use. According to an exemplary embodiment of the present general inventive concept, the bag 20 may be disposed near a front of the stand 10, i.e., away from the counterweight 400, so that it is disposed closer to the ends of the legs 110. Since the legs 110 may splay apart from each other, as illustrated for example in FIGS. 1A-1D, by disposing the bag 20 closer to the ends of the legs 110, the bag 20 may be disposed over a wider base, offering more stability as the bag 20 swings back and forth during use. Two additional stabilizing factors associated with the stand 10 may also be included. First, the second brace 130 may support the arm 200 while it is angled towards the front of the stand 10. In this manner, the mass of the second brace 130 and the arm 200 may be moved towards the wider front of the base 100, which may help to stabilize the stand 10. Second, the counterweight 400 located behind the arm 200 may help counterbalance the weight of the bag 20, especially if the bag 20 swings towards the arm 200 or over the front of the stand 10 during use.

Additional features of the stand 10, including side brace (s) 500 and tether strap 600, described in detail below with regard to FIGS. 8 and 10A-C, may further add stability while the bag 20 is in use or experiencing pendulum motion.

According to exemplary embodiments of the present general inventive concept, one or more of the wheels 140 may include a wheel lock 145 to allow a user to lock the wheel 140 in place so that it does not roll or otherwise move until the wheel lock 145 is disengaged. Wheel lock(s) 145 therefore may allow the stand 10 to be secured in place, without the need for sandbags or other anchoring to keep it from moving.

Figure 2A:
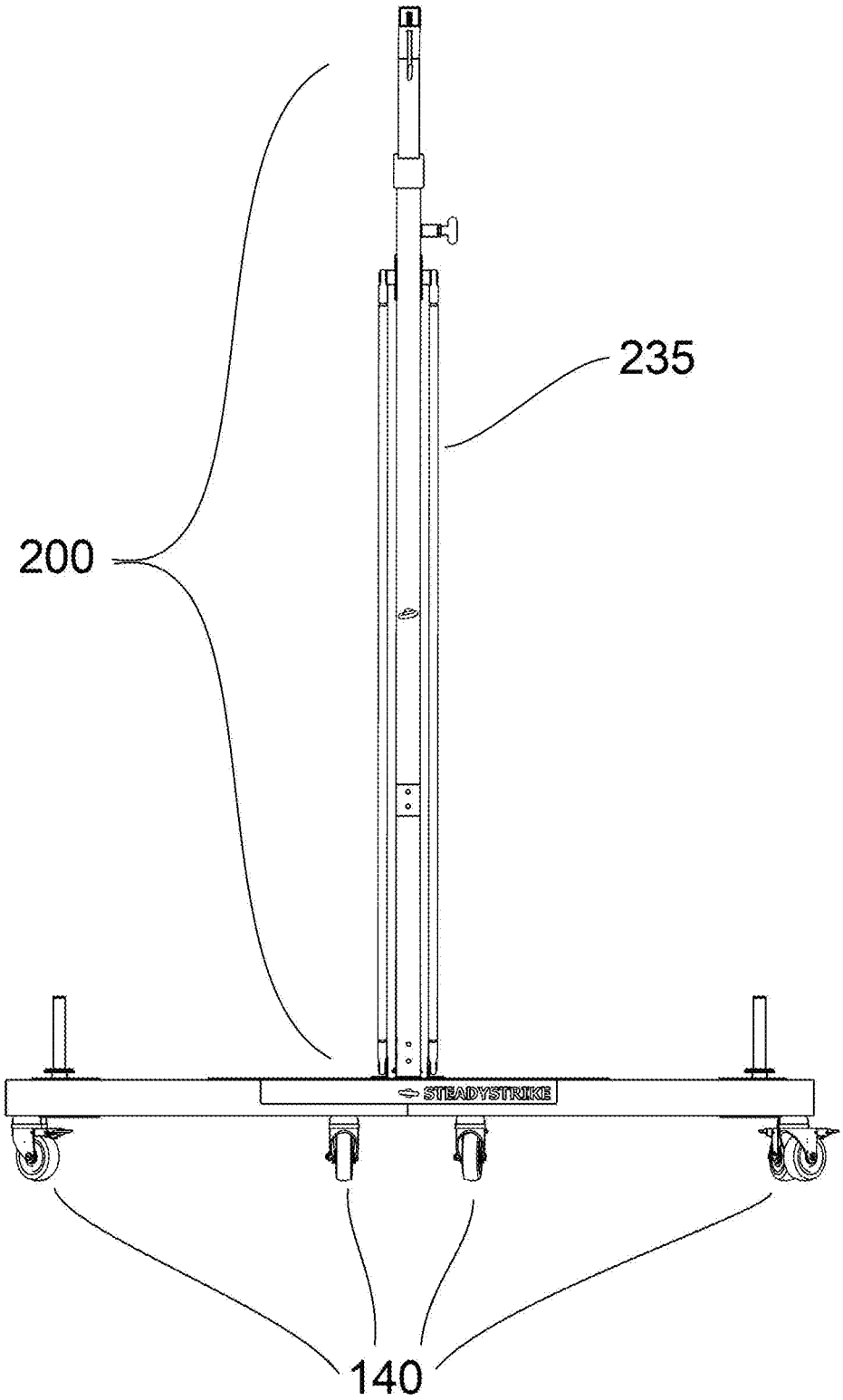
FIG. 2A illustrates a front plan view of a mobile heavy bag stand according to an exemplary embodiment of the present general inventive concept.
Figure 2B:
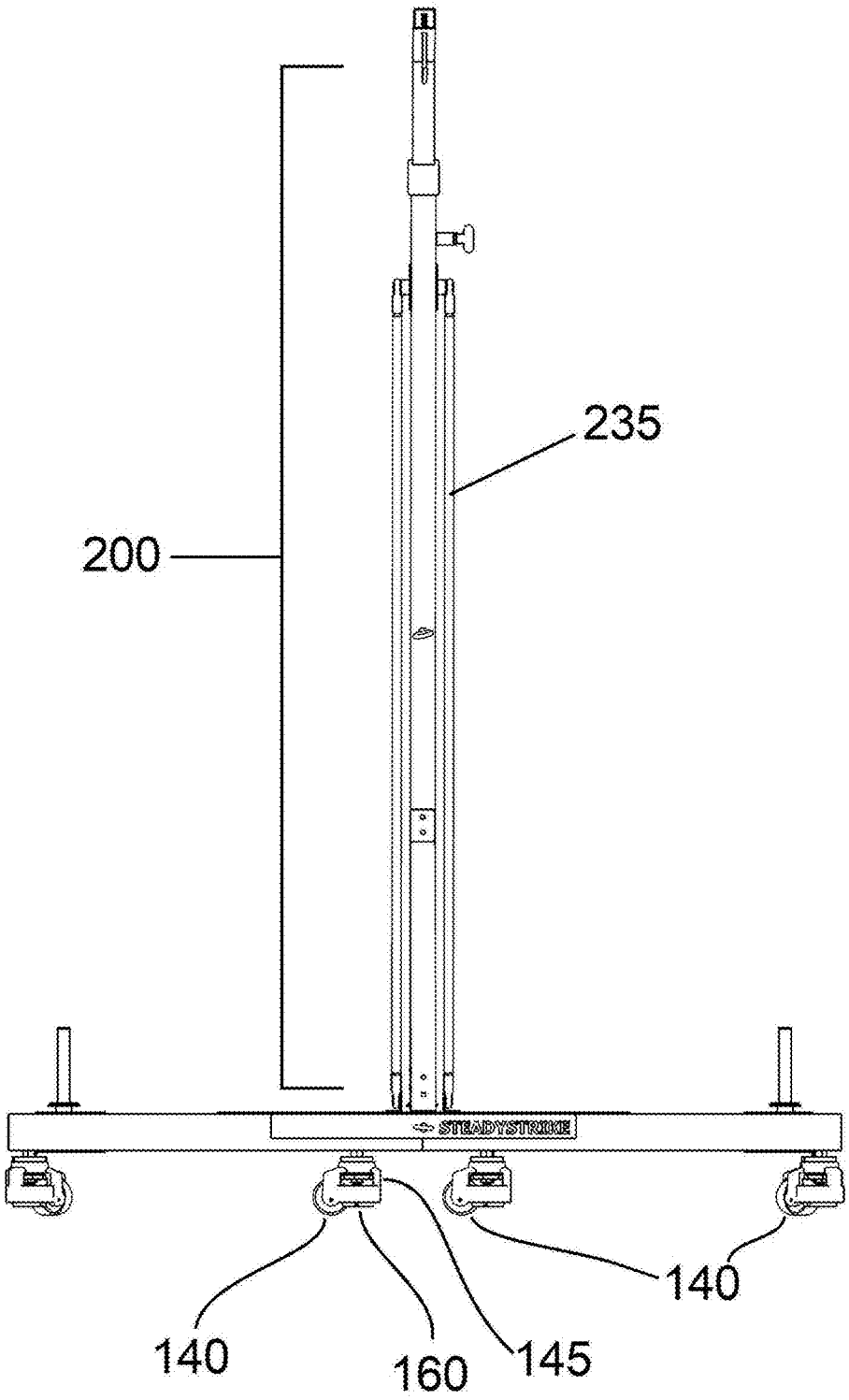
FIG. 2B illustrates a front plan view of a mobile heavy bag stand according to another exemplary embodiment of the present general inventive concept.
Figure 2C:
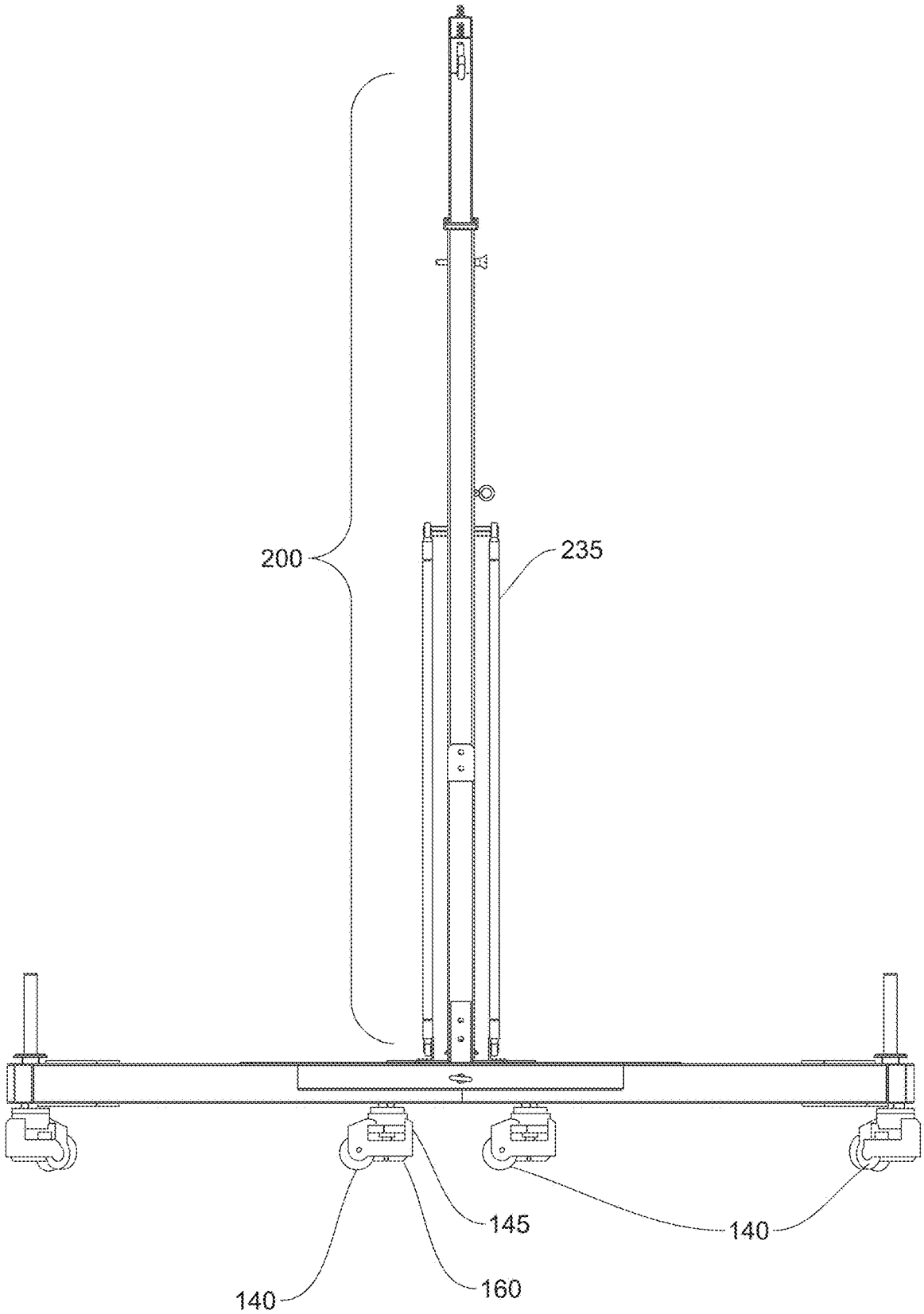
FIG. 2C illustrates a front plan view of a mobile heavy bag stand according to another exemplary embodiment of the present general inventive concept.

The wheels 140 and wheel locks 145 may vary according to different exemplary embodiments of the present general inventive concept. Wheels 140 may have any form suitable to carry the weight of the stand 10 and permit the stand 10 to be moved on the wheels 140. Furthermore, wheel locks 145 may have any form which may be moved between an engaged state in which the wheel locks 145 limit movement of wheels 140, and a disengaged state in which the stand 10 is allowed to move freely on wheels 140. In the exemplary embodiments of the present general inventive concept illustrated in FIGS. 1A and 2A, the wheels 140 may be caster wheels, and the wheel lock 145 may be a lever that applies friction to the wheel 140 to prevent rotation. In the exemplary embodiments of the present general inventive concept illustrated in FIGS. 1B, 2B, 13A, and 13B, the wheels 140 may instead be caster wheels made to move between an active position in contact with the ground and an inactive position in which they do not contact the ground. In this exemplary embodiment of the present general inventive concept, the wheel lock 145 may be for example a lever which moves the wheel 140 between the active and inactive position. In this exemplary embodiment, when the wheels 140 are moved to the inactive position the stand 10 may experience reduced "wiggle," or minor motion caused by a locked wheel 140 still moving slightly when a user strikes the bag 20 attached to the stand 10. When the wheels 140 are in the inactive position the stand 10 may rest on feet 160. These feet 160 may be integrated into the wheels 140 as illustrated in FIGS. 1B, 2B, 2C, and 13B. According to exemplary embodiments of the present general inventive concept, feet 160 may be made of, for example, metal, rubber, or plastic, and may serve as ground contact points when the wheel locks 145 are engaged, or when the wheels 140 are in the inactive position.

Figure 13B:
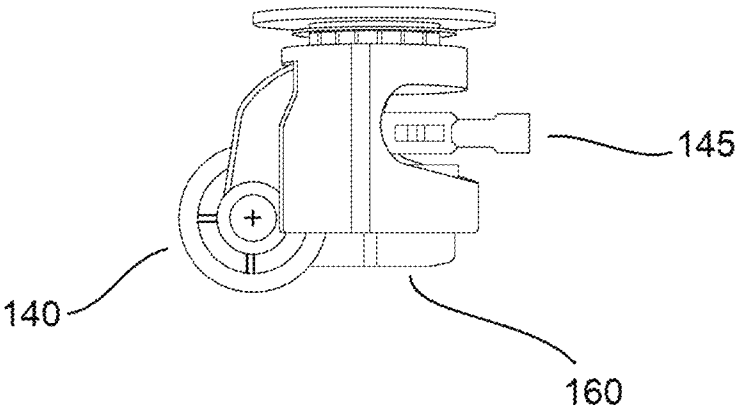
FIGS. 13A-B illustrates wheels and wheel locks according to other exemplary embodiments of the present general inventive concept.
Figure 13A:
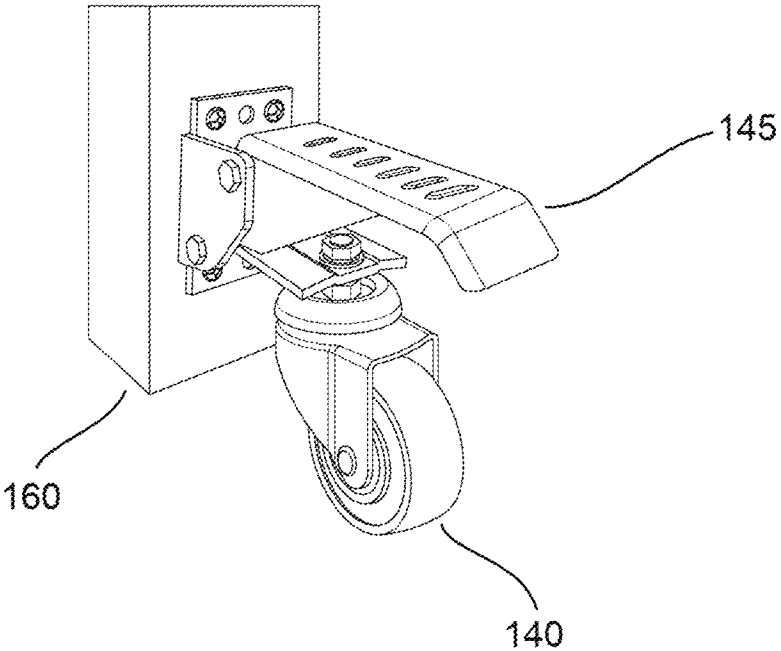

According to another exemplary embodiment of the present general inventive concept feet 160 may be mounted separately from the wheels 140 on the stand 10, as illustrated for example in FIG. 13A, showing a wheel 140 in an inactive position in which it does not touch the floor and allows the stand 10 to rest on foot 160. In this exemplary embodiment of the present general inventive concept the wheel lock 145 may be a lever disposed on or near the wheel 140. A user may use the wheel lock 145 to move the wheel 140 between the active position in which the wheel contacts the ground and lifts the stand 10 off of feet 160, and an inactive position in which the wheel does not touch the ground and the stand 10 rests on the feet 160.

Figure 13D:
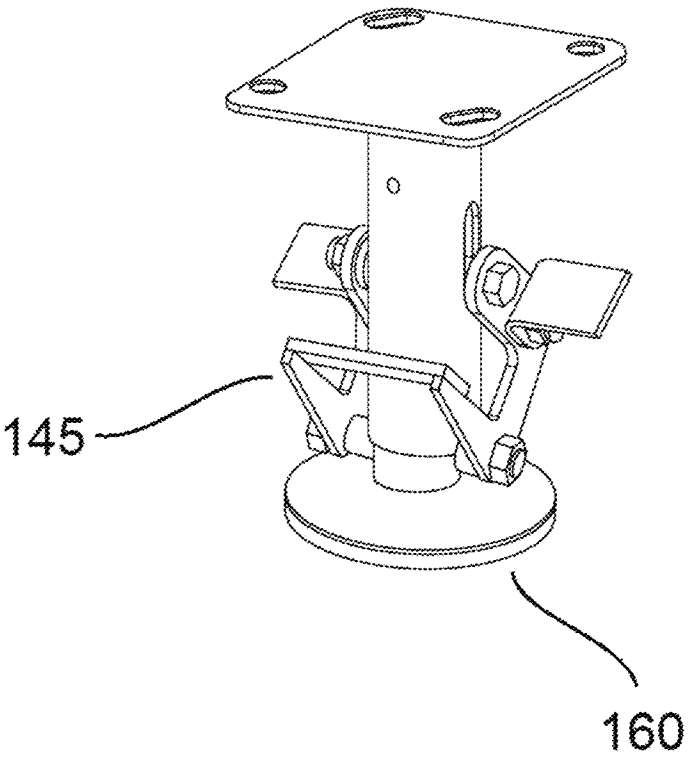
FIGS. 13C-D illustrates a wheel lock in an engaged and disengaged state, respectively, according to another exemplary embodiment of the present general inventive concept.
Figure 13C:
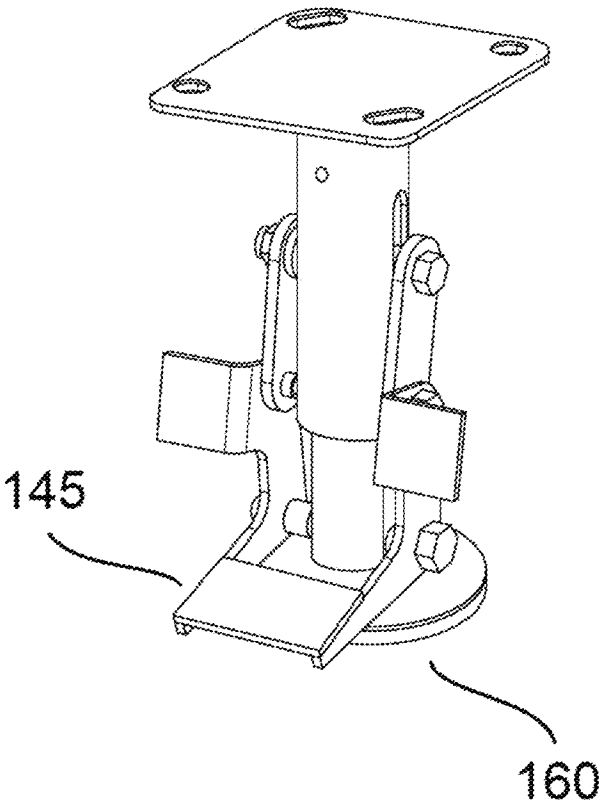

According to another exemplary embodiment of the present general inventive concept, the wheel lock 145 may be separate from the wheel 140. For example, the wheel lock 145 may comprise a floor lock, or a foot 160 which may be moved between a disengaged position in which it does not touch the ground and allows the stand 10 to move on wheels 140, and an engaged position in which the foot 160 is extended to contact the ground and lift the weight of the stand 10 off of the wheels 140, thereby preventing the stand 10 from moving on the wheels 140. An exemplary embodiment of a floor lock is illustrated in FIGS. 13C and 13D. FIG. 13C illustrates a floor lock in an engaged position, and FIG. 13D illustrates the floor lock in a disengaged position.

Figure 1C:
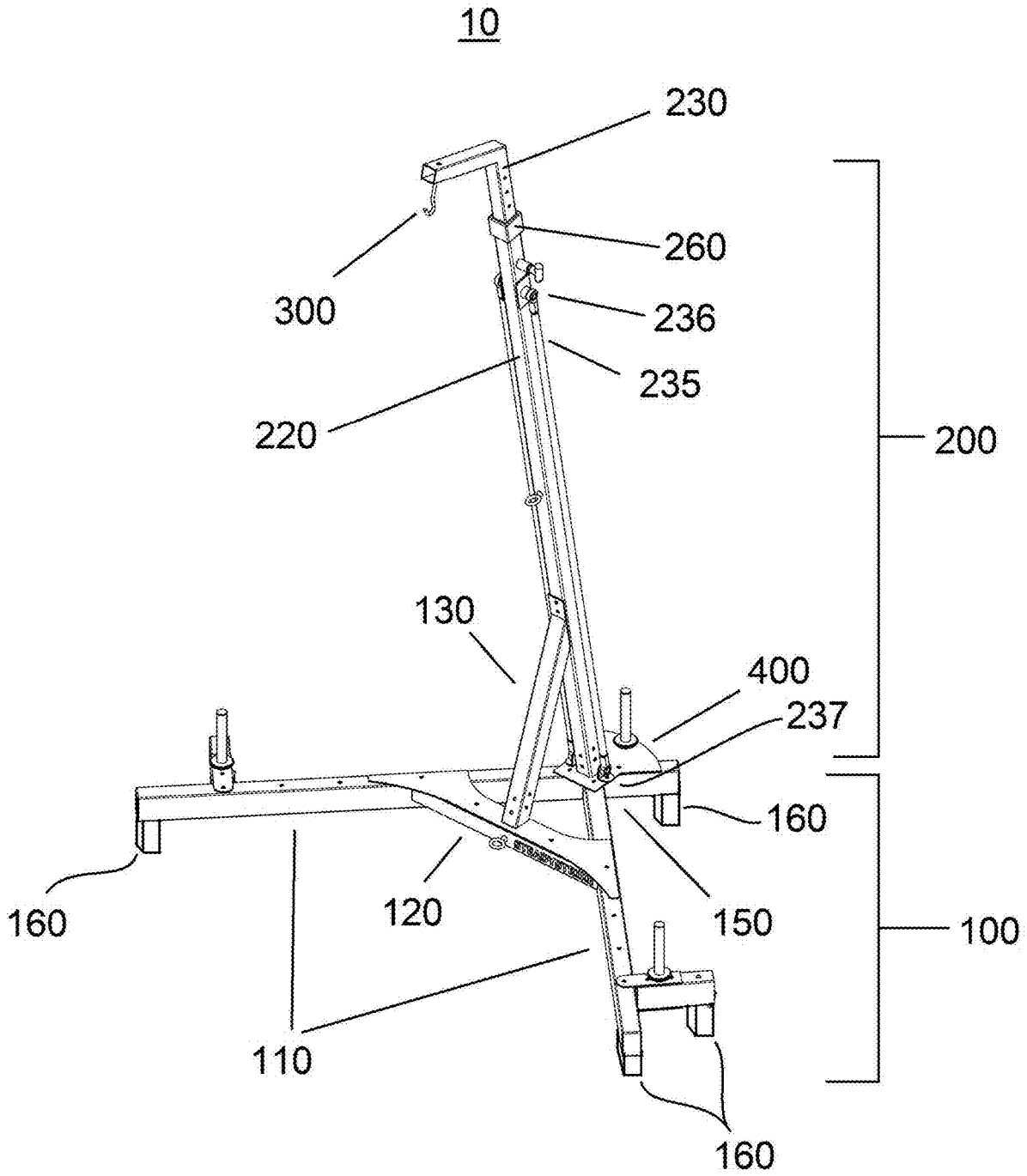
FIG. 1C illustrates a front perspective view of a mobile heavy bag stand according to another exemplary embodiment of the present general inventive concept.

According to another exemplary embodiment of the present general inventive concept, the stand 10 may omit wheels 140 and wheel locks 145 partially or entirely, and may instead rest directly on feet 160 attached to the legs 110. An exemplary embodiment of a stand 10 including such feet 160 is illustrated in FIG. 1C. Since the stand 10 supported solely on these feet 160 is not permanently affixed to the floor or a wall, the stand 10 may remain moveable, for example by a user picking up the stand 10 and moving it to a desired location. It will be understood that the feet 160 illustrated in FIG. 1C are only examples, and that any other shape or size of feet 160 may be used in other exemplary embodiments of the present general inventive concept.

According to exemplary embodiments of the present general inventive concept, regardless of how many wheels 140 the stand 10 may have, the stand 10 may maintain at least four points of contact with the ground at all times. As a result, the stand 10 may remain stable and absorb the vibration and movement of the bag 20 when the bag 20 is struck.

Figure 6A:
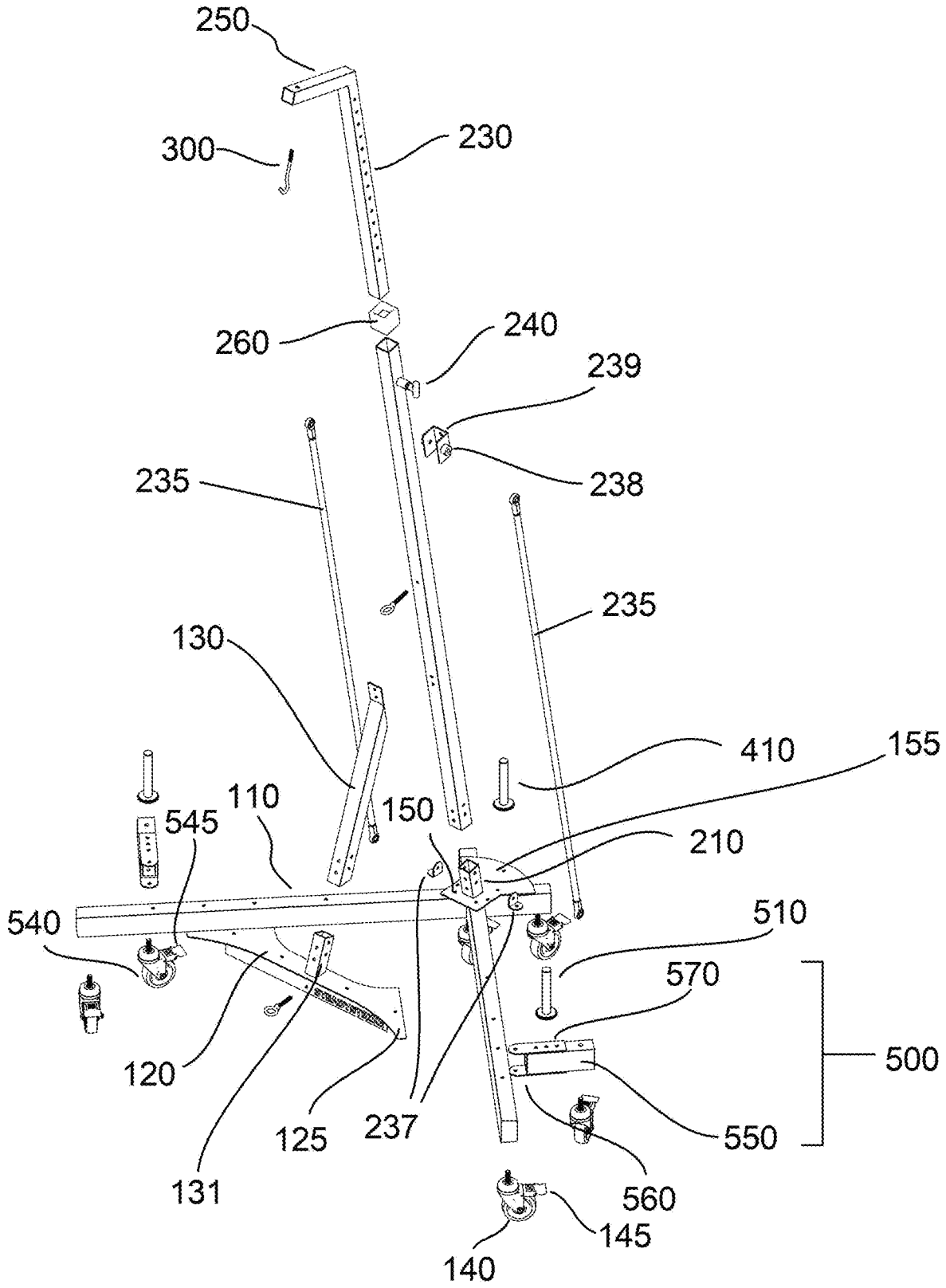
FIG. 6A illustrates an exploded front perspective view of a mobile heavy bag stand according to an exemplary embodiment of the present general inventive concept.
Figure 6B:
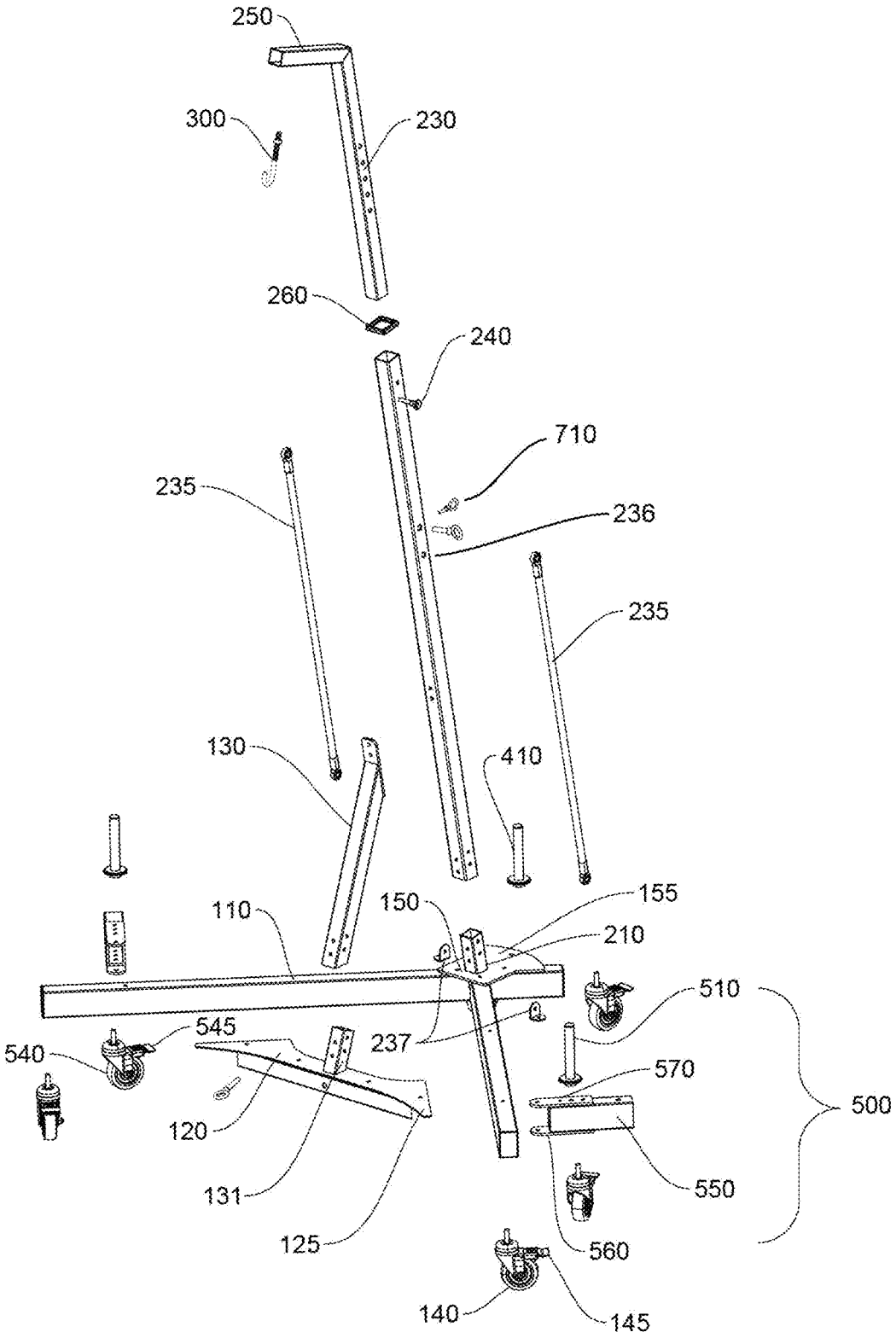
FIG. 6B illustrates an exploded front perspective view of a mobile heavy bag stand according to an exemplary embodiment of the present general inventive concept.

According to exemplary embodiments of the present general inventive concept, the support bracket 150 is a structure which connects the legs 110 and the arm 200. As illustrated in FIGS. 4, 6A, and 6B, according to exemplary embodiments of the present general inventive concept the support bracket 150 may include the foot 210 of arm 200. The support bracket 150 may further include a platform 155 (illustrated in FIGS. 6A and 6B) to support the anchor point 410 and weights 420 of counterweight 400. According to exemplary embodiments of the present general inventive concept, the support bracket 150 may be located at an intersection of two or more legs 110, and may be affixed to the legs 110 via screws, bolts, welds, glue, or any other attachment method. The platform 155 may be supported on top of one or more of the legs 110.

The arm 200 may comprise the foot 210 as well as a support 220 and an extension 230. The foot 210 may connect the arm 200 to the base 100 via the support bracket 150. The support 220 may be attached to the foot 210, for example by the foot 210 fitting inside of the support 220 and being affixed in place via screws, welds, or any other attachment method. By fitting the foot 210 into the support 220, the connection of the arm 200 to the base 100 may be made more secure than if, say, the arm 200 were attached directly to the base 100, e.g. with bolts. The extension 230 may be attached to the support 220 and may move independently of the support 220, allowing the arm 200's overall length to be adjusted. According to an exemplary embodiment of the present general inventive concept, the extension 230 may fit inside the support 220. The extension 230 may be secured temporarily to the support 220 by a lock 240. As desired, a user may remove or disengage the lock 240, adjust the position of the extension 230 relative to the support 220, i.e., extend or shorten the arm 200, and then re-attach or re-engage the lock 240 to secure the extension 230 to the support 220. According to exemplary embodiments of the present general inventive concept, the lock 240 may be a pull pin, i.e. a pin made to be inserted through the support 220 and into one of a series of holes on the extension 230 to secure the support 220 and extension 230 together. It will be understood this is just an example, and the lock 240 may comprise any method or apparatus to secure the extension 230 to the support 220, for example a push button ball release pin. By adjusting the relative position of the support 220 and the extension 230, a bag 20 hanging from bag support 300 can be positioned at a desired height for an individual user.

Figure 7:
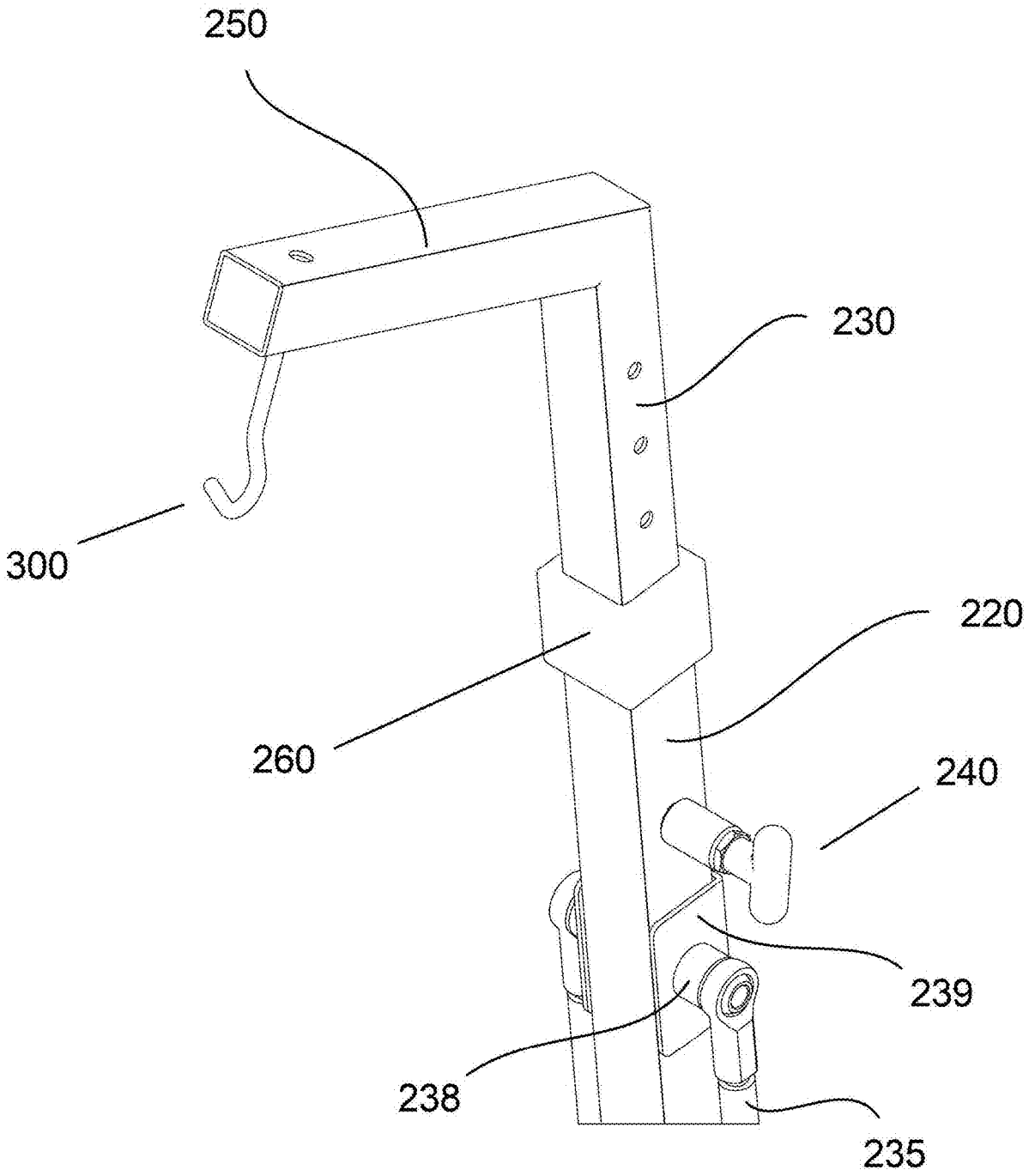
FIG. 7 illustrates an arm extension and bag support of a mobile heavy bag stand according to an exemplary embodiment of the present general inventive concept.

According to exemplary embodiments of the present general inventive concept, the arm 200 may further include a collar 260 disposed between the support 220 and the extension 230. A collar 260 according to an exemplary embodiment of the present general inventive concept is illustrated in FIG. 7. The collar 260 may enhance fit and finish, and may dampen vibrations or "rattle" between the support 220 and the extension 230. The collar 260 may be made to fit around the arm 200 where the extension 230 meets the support 220. According to exemplary embodiments of the present general inventive concept, the collar 260 may fit partially over the support 220 and partially over the extension 230. The form of the collar 260, e.g. width and thickness, may vary between different exemplary embodiments of the present general inventive concept. For example, in the exemplary embodiment illustrated in FIG. 6A, the collar 260 is relatively wider than the exemplary embodiment illustrated in FIG. 6B, yet both embodiments of the collar 260 may serve the same purpose.

According to exemplary embodiments of the present general inventive concept, the arm 200 may further include one or more side struts 235. Each side strut 235 may be, for example, a rod or similar structure attached to the arm 200 at a first anchor point 236 and to the base 100 at a second anchor point 237. According to exemplary embodiments of the present general inventive concept, the second anchor point 237 may be disposed on the support bracket 150, as illustrated in FIG. 9.

A side strut 235 may help stiffen the arm 200 by enlarging the arm 200's effective footprint, i.e. by widening the area of the arm 200 that connects to the base 100 or the support bracket 150, without adding the additional weight that would come from widening the arm 200 itself. As a result, the side strut 235 may stiffen the arm 200, allowing it to better resist vibrations while the bag 20 is in use, as well as lateral sway or twist. Side strut(s) 235 may thereby lessen or prevent weakening of welds, bolts, or other connections in the stand 10 over time.

The length of the side strut(s) 235 may vary in different exemplary embodiments of the present general inventive concept. In the exemplary embodiment illustrated in FIG. 6A, a side strut 235 may extend along approximately 90% of the length of the support 220, such that that first anchor point 236 is near the lock 240. In this exemplary embodiment, the first anchor point 236 may be a bracket 239 attached to the outside of the arm 200, so that the side strut 235 and the first anchor point 236 do not interfere with the lock 240 or the movement of the extension 230. Alternatively, according to the exemplary embodiments of the present general inventive concept illustrated in FIGS. 1D, 20, 3B, and 6B, the side strut(s) 235 may extend along approximately half of the length of the support 220. In these exemplary embodiments, the first anchor point 236 may be, e.g., a bolt extending through the arm 200 to connect two side struts 235 to each other and to the arm 200. In this exemplary embodiment the first anchor point 236 may be positioned at a location on the arm 200 that a bolt extending through the arm 200 would not interfere with the movement of the extension 230 inside of the support 220.

One or more spacers 238 (illustrated in FIG. 6A) may be attached to a side strut 235 at either or both of the first and second anchor points 236 and 237. A spacer 238 may be used to define a distance between the arm 200 and the side strut 235. One or more spacers 238 may be used in this way so that each side strut 235 is substantially parallel to the arm 200. If the side strut 235 is parallel to the arm 200, then the side strut 235 may stiffen the arm 200 without blocking access to the bag 20, i.e., the side strut 235 does not extend into an area where a user may try to punch or kick the bag 20. Alternatively, a spacer 238 and/or the position of the second anchor point 237 may be set such that the strut 235 is not parallel to the arm 200. If, for example, the support bracket 150 is of sufficient size to move the second anchor point 237 away from the arm 200, the side strut 235 may be mounted at an angle to the arm 200, thereby offering additional lateral support to the arm 200 than if the side strut 235 were parallel to the arm 200.

The bag support 300 may be mounted at a distal end 250 of the arm 200. According to exemplary embodiments of the present general inventive concept, the bag support 300 may be a hook, from which a bag 20 such as a punching bag may be securely hung. As illustrated in FIG. 7, according to exemplary embodiments of the present general inventive concept the distal end 250 of the arm 200 may be angled away from the extension 230. The distal end 250 may be angled to be parallel to the ground, or alternatively may be angled to be non-parallel to the ground, for example at an angle of about 5 degrees to the ground.

According to exemplary embodiments of the present general inventive concept, the arm 200 may be angled towards a front end of the legs 110, as illustrated for example in FIGS. 3A and 3B. Angling the arm 200 in this manner may shift the bag 20 away from the counterweight 400 and arm 200, and accordingly may shift the center of gravity of the stand 10 in the same direction. Angling the arm 200 may help position the bag 20 over a front of the stand 10, as illustrated for example in FIGS. 10A-B, 11A-B, and 12A. As described above, the "front" of the stand 10 may be a side of the stand 10 disposed opposite the counterweight 400. If the bag 20 is positioned over a front of the stand 10, the majority of the weight of the stand 10 and bag 20 may be located over the front of the stand 10, including the first brace 120 and front ends of the arms 110. As described above, this may make the stand 10 more stable, since the weight is over a wider support base. Furthermore, less additional weight needs to be added to a front of the stand 10 to stabilize it, as opposed to if the arm 200 were angled straight up so that the bag 20 were positioned more over a middle portion of the stand 100. Additionally, if the arm 200 is angled forward such that the bag 20 is shifted away from the arm 200, then the bag 20 may be more readily accessed laterally, for example for certain punches or kicks that come in from the side. Furthermore the arm 200 and any counterweight 400 may be more accessible by the user to make adjustments thereto, since the bag 20 would not contact or obscure these components. According to exemplary embodiments of the present general inventive concept, braces 120, 130 may not cover or interfere with the counterweight 400 or the lock 240, so that a user may freely access and adjust the number of weights 420 on the counterweight 400 or adjust the overall length of the arm 200 as desired, without needing to move or remove the bag 20 first.

Figure 11B:
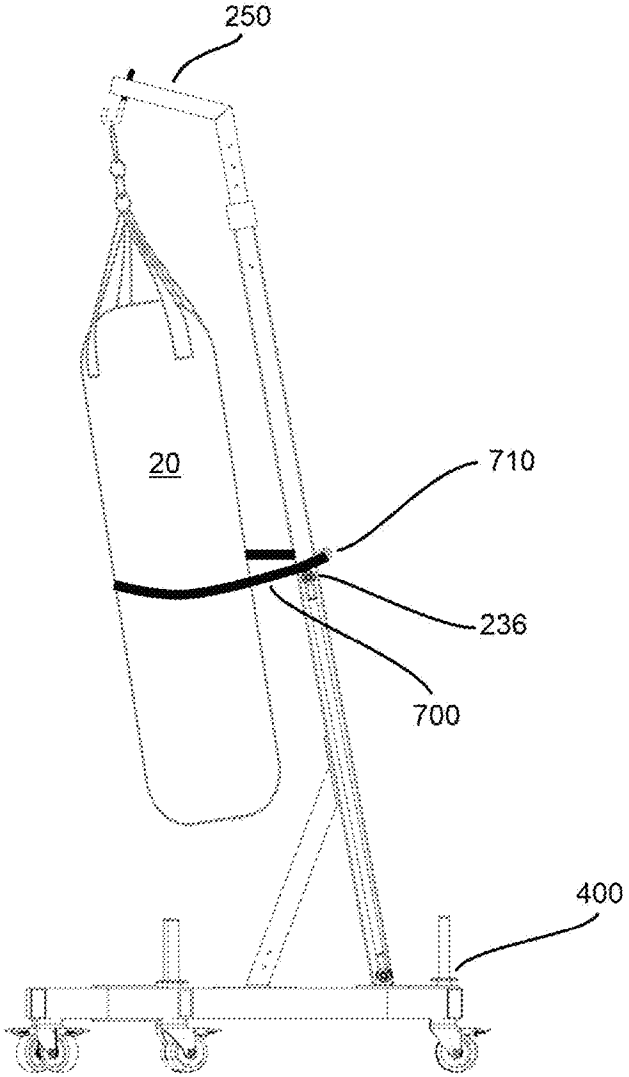
FIGS. 11A-11B illustrate side elevation views of a bag restraint according to exemplary embodiments of the present general inventive concept.
Figure 11A:
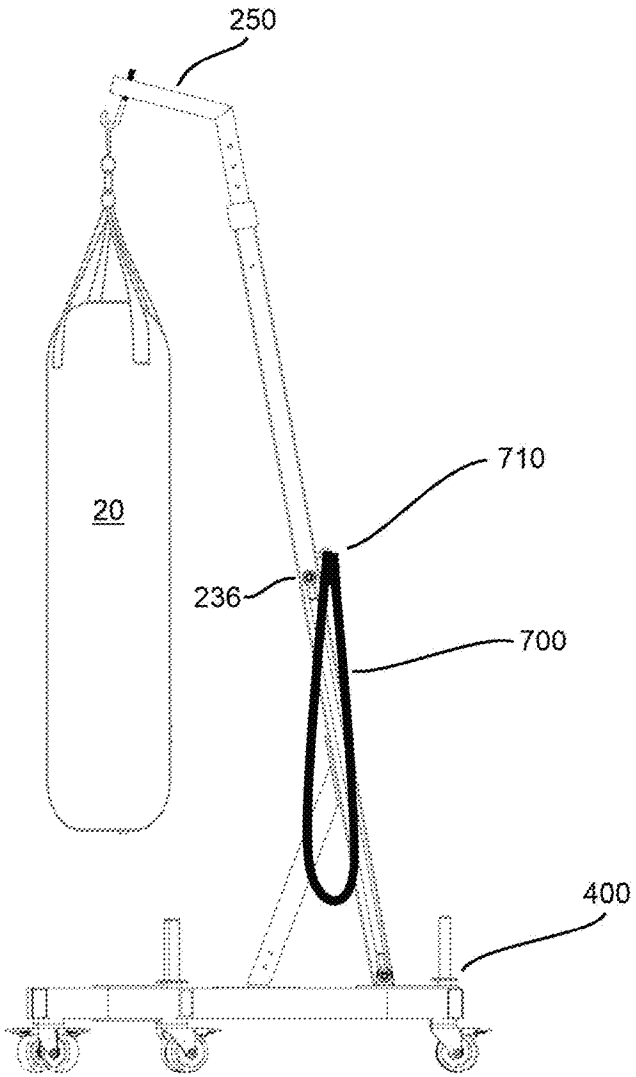

Angling the arm 200 may also allow the bag 20 to be held against the arm 200 for storage, for example via a bag restraint 700 (described in detail below with reference to FIGS. 11A-11B). Still further, angling the arm 200 so that the bag 20 is disposed away from the arm 200 may allow for different sizes of bags 20 to be used, for example bags 20 having different lengths or widths, without concern about the bag 20 contacting or interfering with the arm 200, base 100, or counterweight 400.

According to exemplary embodiments of the present general inventive concept, the mobile bag stand 10 may further include one or more side braces 500. Each side brace 500 may be attached to a leg 110, to make an additional point of contact with the ground and widen the stand 10's effective footprint, helping to keep the stand 10 from tipping over during use, for example if the bag 20 is experiencing pendulum motion and swinging back and forth violently under impacts. According to exemplary embodiments of the present general inventive concept, a side brace 500 may be separably attached, i.e., held on a leg 110 via a screw, bolt, clamp, or other removable attachment method which may be engaged and disengaged by a user. As such, a side brace 500 may be attached, removed, or moved to a different part of the base 100 as desired by a user. According to exemplary embodiments of the present general inventive concept, when attached to the leg 110, the side brace 500 may be disposed substantially perpendicular to the leg 110 and extend away from the leg 110.

Figure 8:
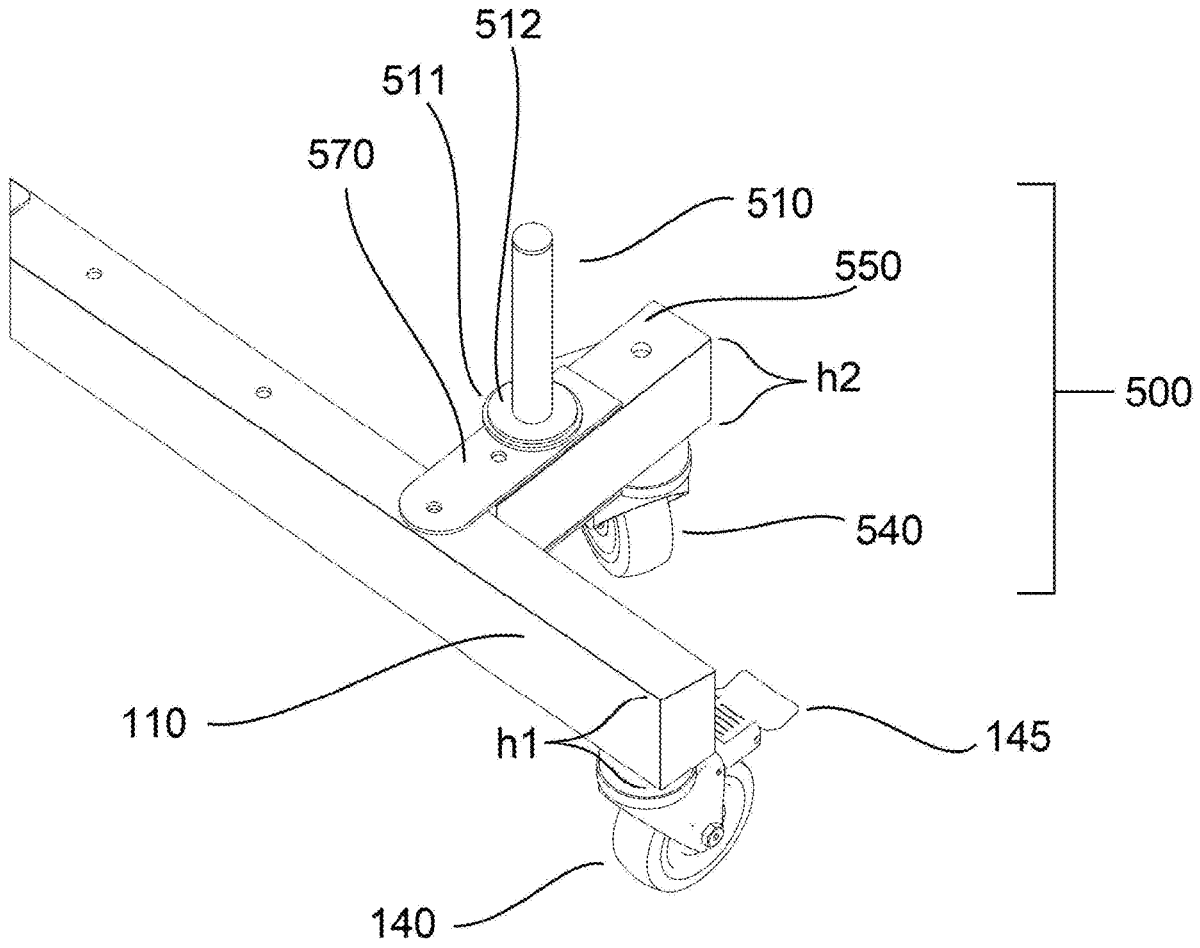
FIG. 8 illustrates a side brace of a mobile heavy bag stand according to an exemplary embodiment of the present general inventive concept.

As illustrated in FIG. 8, according to exemplary embodiments of the present general inventive concept the side brace 500 may include a main bar 550, a lower plate 560 (illustrated in FIG. 6A), and an upper plate 570. The main bar 550 may be a bar with a uniform cross-section, for example rectangular. According to exemplary embodiments of the present general inventive concept, the main bar 550 may have a predefined thickness h2, which may be approximately the same as a thickness h1 of the legs 110. According to exemplary embodiments of the present general inventive concept, the lower plate 560 may be attached to a lower portion of the main bar 550, and a first end of the lower plate 560 may extend beyond an end of the main bar 550, such that the lower plate 560 may fit under a leg 110 of the stand 110 when the end of the main bar 550 is placed up against the leg 110. The lower plate 560 may be permanently attached to the main bar 550, e.g., with welds, or may be separably attached, e.g., with screws, bolts, etc. The upper plate 570 may similarly be permanently or separably attached to an upper portion the main bar 550, opposite the lower plate 560. A first end of the upper plate 570 may extend beyond the end of the main bar 550 by a similar length as the lower plate 560. According to exemplary embodiments of the present general inventive concept, the lower plate 560 may be attached to the main bar 550, the main bar 550 and lower plate 560 may be placed against a leg 110, and then the upper plate 570 may be attached to the main bar 550 and the leg 110 to connect the side brace 500 to the leg 110. According to an exemplary embodiment of the present general inventive concept, a single bolt may extend through the upper plate 570, leg 110, and lower plate 560 to secure these components together.

A distance between the first end of the lower plate 560 and the first end of the upper plate 570 may be approximately a thickness h1 of the leg 110, such that the leg 110 may be held securely between the ends of the lower plate 560 and upper plate 570. One or both of the lower plate 560 and upper plate 570 may include a pad or similar cushion to prevent friction or scuffing while the stand 10 and side brace 500 are in use.

Each side brace 500 may include a wheel 540, which may include a wheel lock 545 (illustrated in FIG. 6A). The wheel 540 and wheel lock 545 may function similarly to the wheel 140 and wheel lock 145, respectively. According to exemplary embodiments of the present general inventive concept, wheel(s) 540 may lack wheel locks 545. According to other exemplary embodiments of the present general inventive concept, the wheel(s) 540 may be omitted entirely and replaced with static feet 160, similar to those illustrated in FIG. 1C. Wheel(s) 540 may be replaced with feet 160 if they do not interfere with movement of the stand 10 when wheel locks 145 are disengaged. For example, wheel(s) 540 may be replaced with feet 160 if wheels 140 on the stand 10 are, for example, the type of wheel 140 illustrated in FIGS. 1B, 2B, 2C, and 13B, which may raise and lower the stand 10 such that the stand 10 may change between being supported on wheels 140 and resting on feet 160. According to another exemplary embodiment of the present general inventive concept, wheel(s) 540 may be replaced with feet 160 if wheels 140 on the base 100 are replaced with feet 160, as in the exemplary embodiment of the present general inventive concept illustrated in FIG. 1C.

The side brace(s) 500 may further include anchor point(s) 510 similar to the anchor point 410 of counterweight 400, allowing one or more weights 520 to be placed on the side brace(s) 500, similarly to weights 420 being placed on the anchor point 410 of counterweight 400. Weight(s) 520 may help stabilize the stand 10 without increasing the floor space taken up by the stand 10. Exemplary embodiments of weights 520 are illustrated in FIGS. 3A-3B. Weights 520 are omitted from the other drawings for clarity. As illustrated in the drawings, anchor point 510 may be a post or tube configured to fit through a hole in the weight(s) 520, similarly to the anchor point 410 fitting into the weight(s) 420. According to an exemplary embodiment of the present general inventive concept, the anchor point 510 may further include a spacer 511 and a pad 512 (illustrated in FIG. 8, and illustrated with size exaggerated for clarity in FIGS. 3A and 3B), which may be constructed similarly to the spacer 411 and pad 412 described above in relation to anchor point 410, and may function similarly. According to exemplary embodiments of the present general inventive concept, the anchor point 510 may be attached to the upper plate 570. Furthermore, the anchor point 510 may be positioned on the side brace 500 such that it is positioned away from the leg 110. As such, the weights 520 may be disposed away from the base 100 of the stand 10, effectively increasing the footprint of the stand 10, and accordingly increasing the stand 10's stability.

Similar to the counterweight 400, anchor point 510 and weight(s) 520 may allow a user to customize the balance of the stand 20. Also similar to the counterweight 400, weight (s) 520, and/or the anchor point 510, may be omitted if, for example, the legs 110 are heavy enough to counterbalance the bag 20 hanging from the bag support 300.

Since the side brace(s) 500 may be removed and attached as desired, a user may use one or more side braces 500 where desired according to the instant use of the stand 10, both to adjust the stability of the stand 10, or adjust accessibility to a particular part of the stand 10. For example, if a user wants to practice kicks or other moves where their body may pass low to the ground, they may move or remove the side brace(s) 500, so that any weights 520 placed thereon do not interfere with their movements.

Figure 1D:
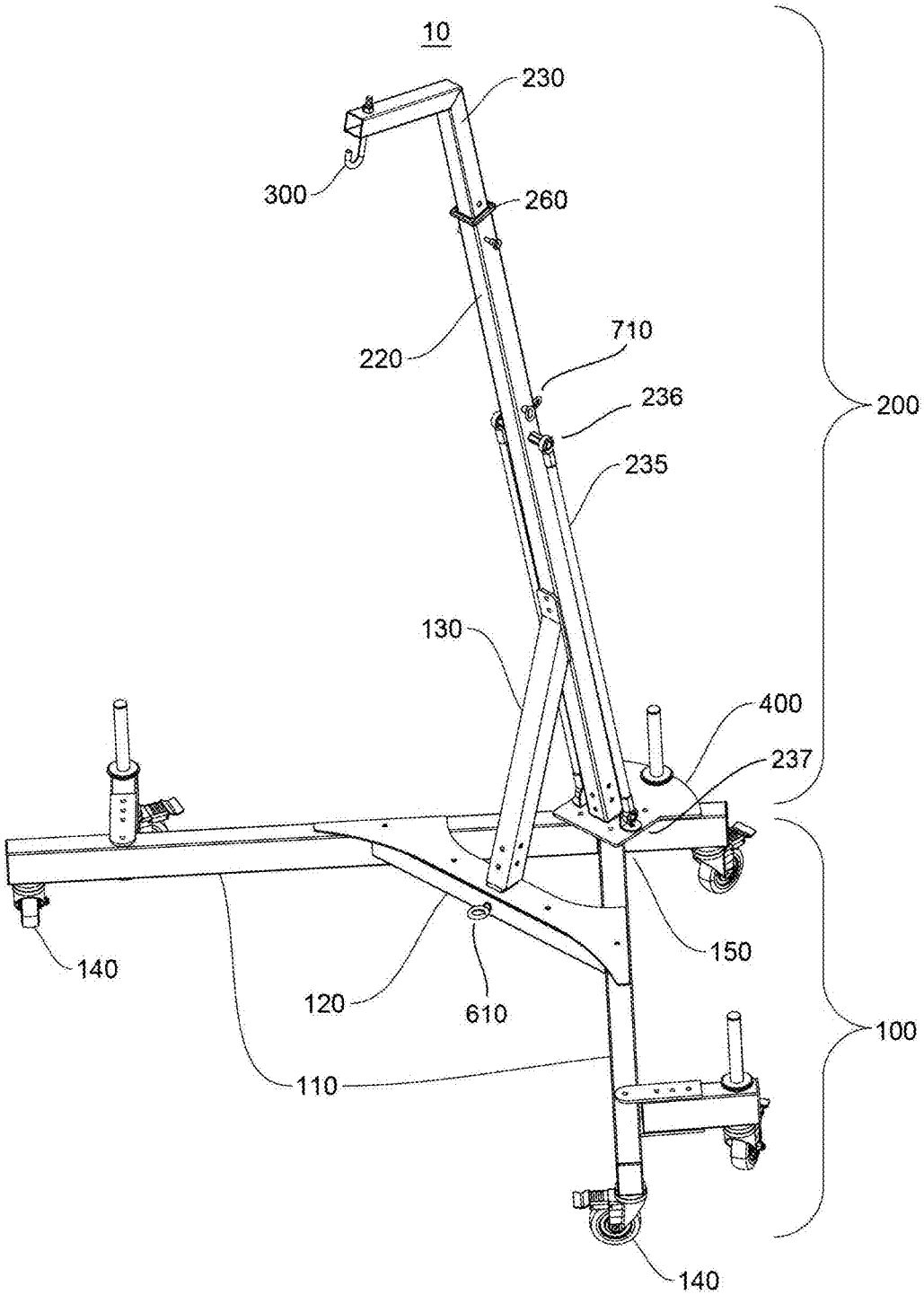
FIG. 1D illustrates a front perspective bag view of a mobile heavy bag stand according to another exemplary embodiment of the present general inventive concept.
Figure 10B:
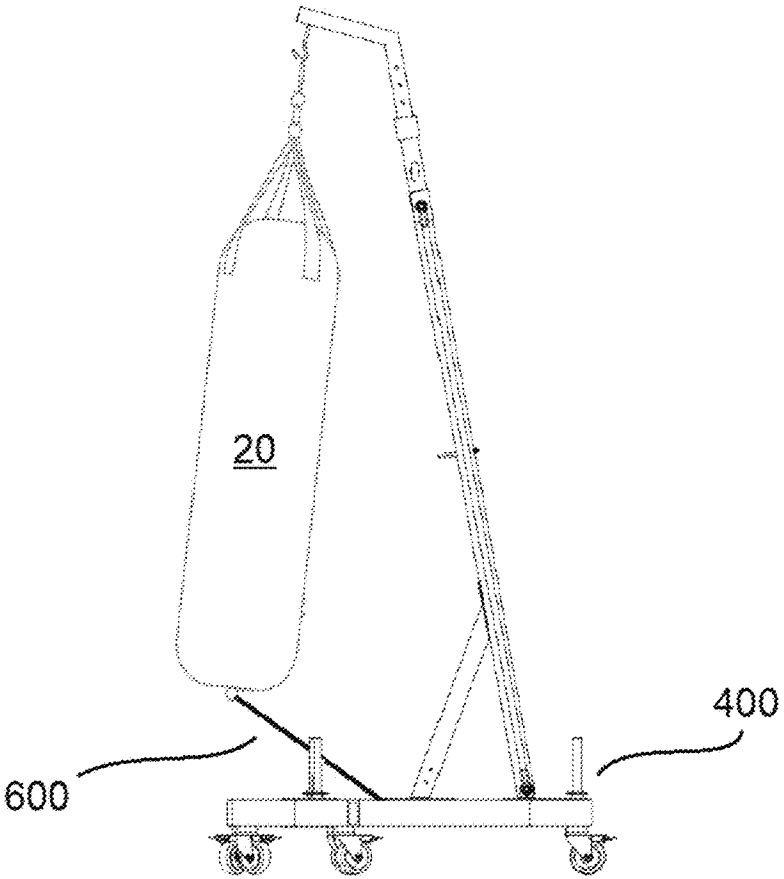
FIGS. 10A-10B illustrate side elevation views of a tether strap according to exemplary embodiments of the present general inventive concept.
Figure 10A:
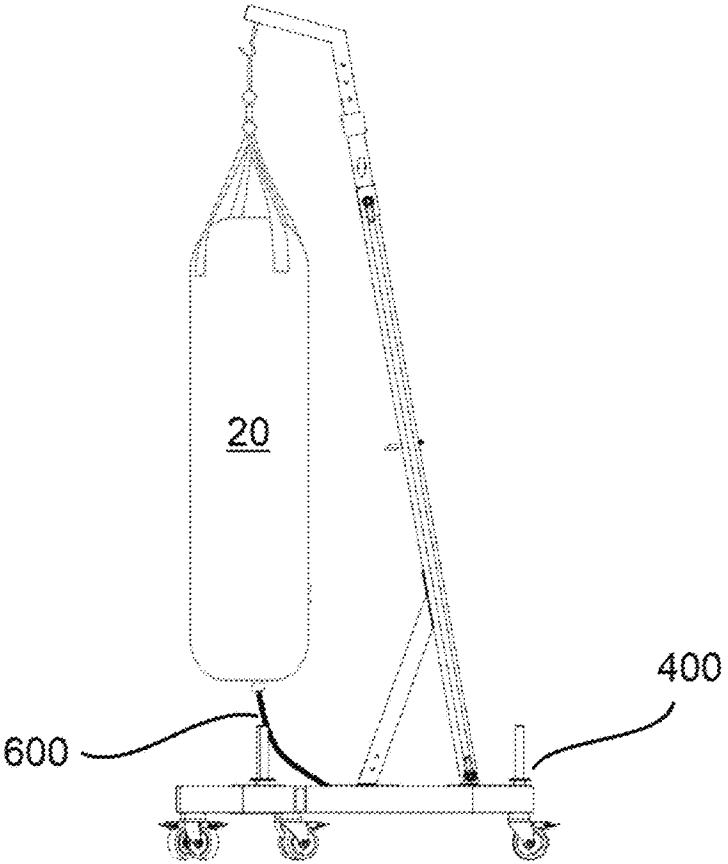
Figure 10C:
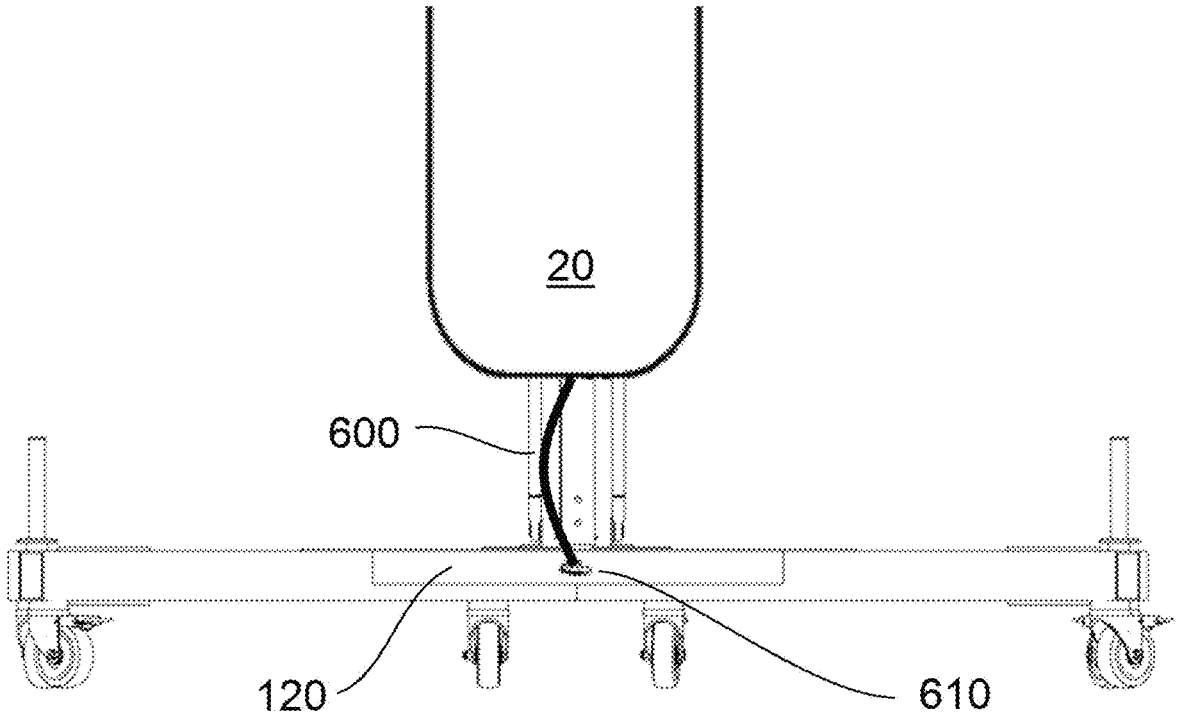
FIG. 10C illustrates a front plan view of a tether strap according to an exemplary embodiment of the present general inventive concept.

According to exemplary embodiments of the present general inventive concept, the mobile bag stand 10 may further include a tether strap 600. The tether strap 600 may be a strap which may be attached to a bag 20 hanging from the bag support 300 before use, e.g., before a user starts striking the bag 20. The tether strap 600 may secure a hanging bag 20 to restrict the bag 20's movement. According to exemplary embodiments of the present general inventive concept, the tether strap 600 may restrict the bag 20 from swinging beyond an edge of the base 100, for example by preventing a lower end of the bag 20 from swinging partially or completely beyond the edge of the base 100, as illustrated in FIG. 10B. In this manner, the bag 20 may be prevented from overbalancing the stand 10 and causing the stand 10 to fall over. The tether strap 600 may be attached at a tether point 610, which may be on the stand 10 close to the base 100, for example on the first brace 120. Exemplary embodiments of such a tether point 610 are illustrated in FIGS. 1D and 10C. According to other exemplary embodiments of the present general inventive concept, the tether point 610 may be mounted on the arm 200 near the foot 210. If the tether strap 600 is secured on or close to the base 100, the strap 600 may be prevented from overbalancing the stand 10. Exemplary embodiments of the present general inventive concept including a tether strap 600 are illustrated in FIGS. 10A-10C. FIG. 10A illustrates a tether strap 600 with the bag 20 at rest, i.e., hanging loose. FIG. 10B illustrates a tether strap 600 under tension, for example from the bag 20 being moved during use. FIG. 10C illustrates a zoomed-in front view of the tether strap 600 at rest, illustrating the tether strap 600 attached to the bottom of the bag 20 and the tether point 610 located on the first brace 120.

According to exemplary embodiments of the present general inventive concept, the stand 10 may further include a bag restraint 700. The bag restraint 700 may be, for example, a strap which may be attached to the bag 20 hanging from the bag support 300 to pull the bag 20 up against the arm 200. In this manner, the bag 20 may be secured for transport, so that it does not swing loosely. Securing the bag 20 in this manner may also permit nesting or storage of multiple stands 10. Exemplary embodiments of the present general inventive concept including a bag restraint 700 are illustrated in FIGS. 11A-11B. FIG. 11A illustrates a stand 10 with a bag restraint 700 at rest, i.e., not used to secure the bag 20. FIG. 11B illustrates a stand 10 with a bag restraint 700 in use to secure the bag 20. As illustrated therein, the bag restraint 700 may be attached to an attachment point 710 on the arm 200. In the exemplary embodiments of the present general inventive concept illustrated in FIGS. 11A and 11B, attachment point 710 is disposed on a back of the arm 200, i.e., on a side of the arm 200 facing away from the bag 20, such that movement of the bag 20 will not push the bag 20 into the attachment point 710. According to the exemplary embodiments of the present general inventive concept illustrated in FIGS. 11A-11B, the attachment point 710 may be disposed at a point on the arm 200 higher than the first anchor point 236 of a side strut 235, i.e., the attachment point 710 may be located closer to the distal end 250 than the first anchor point 236 is. It will be understood that this is an example, and according to different exemplary embodiments of the present general inventive concept, the attachment point 710 may be placed anywhere on the arm 200 from which the bag restraint 700 may restrict the bag 20's movement.

Figure 12A:
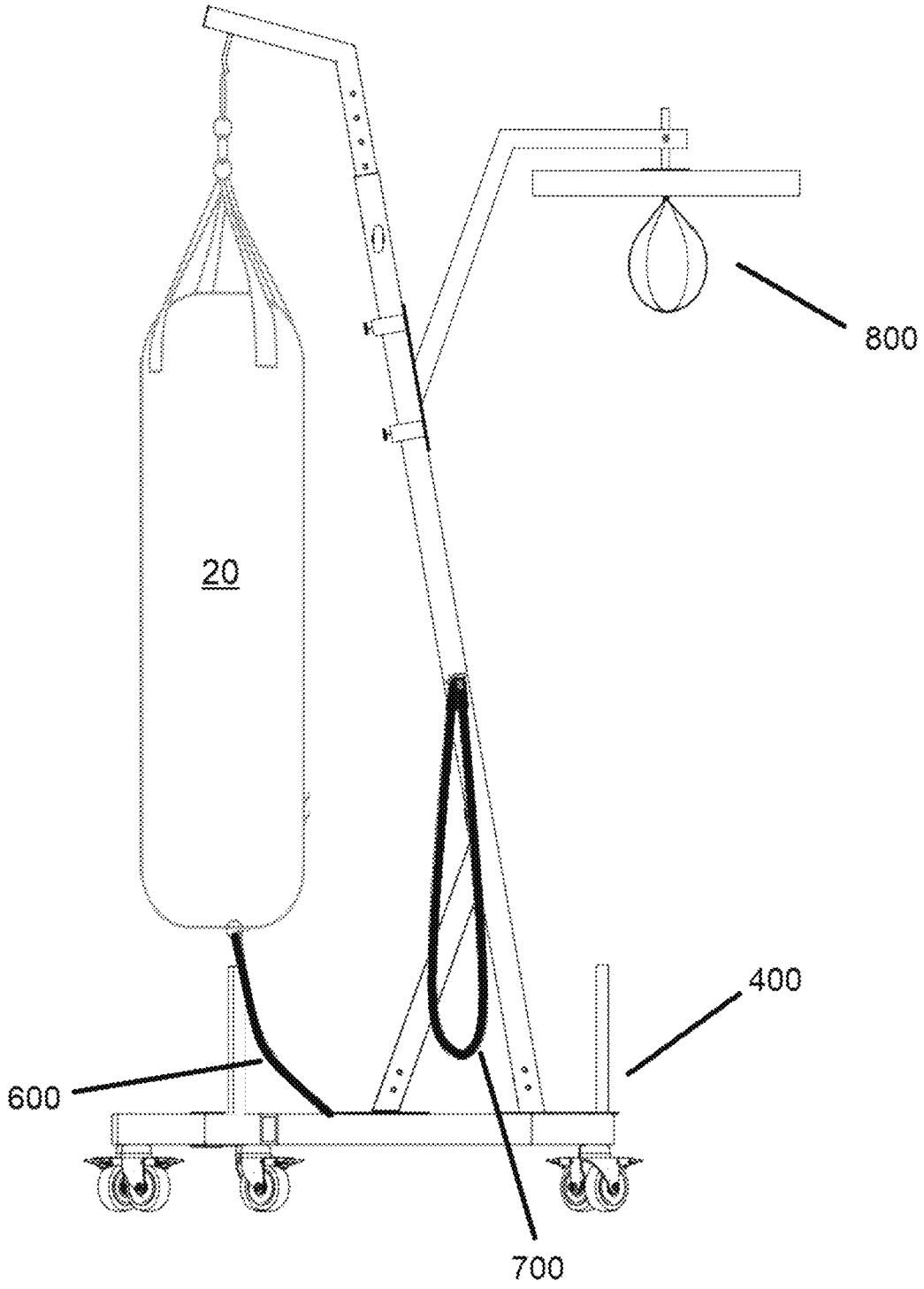
FIG. 12A illustrates a side elevation view of a mobile bag stand with a speedbag attachment according to an exemplary embodiment of the present general inventive concept.
Figure 12B:
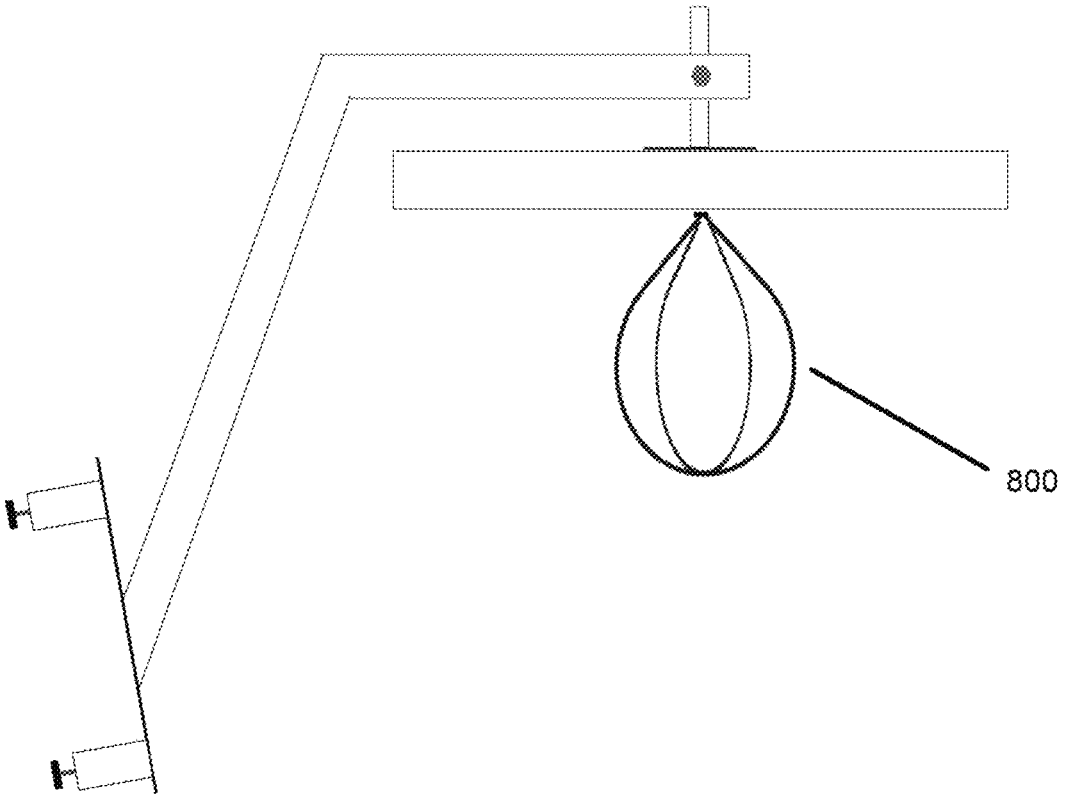
FIG. 12B illustrates a side elevation view of a speedbag attachment according to an exemplary embodiment of the present general inventive concept.

According to exemplary embodiments of the present general inventive concept, the stand 10 may further include one or more attachments for other components, for example a speedbag or other exercise equipment. An exemplary embodiment of a bag stand 10 including a speedbag attachment 800 according to the present general inventive concept is illustrated in FIGS. 12A-12B. FIG. 12B illustrates a zoomed-in side view of the speedbag attachment 800. As illustrated in FIGS. 12A-12B, a speedbag attachment 800 according to an exemplary embodiment of the present general inventive concept may be attached to the arm 200, for example on the support 220. The speedbag attachment 800 may be attached to the arm 200 via, for example, clamps, screws, or other removable attachment methods, so that a user may adjust the height of the speedbag attachment 800, or remove the attachment 800 completely, for example to more easily transport the stand 10 or to attach a different component.

The components of the stand 10 may be designed around available materials. For example, if the stand 10 is made from steel bars which are provided in 20-foot lengths, the base 100 and arm 200 may be designed such that the length of the various parts adds up to a multiple of about 20 feet, such that waste is minimized.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A bag stand, comprising:

a base comprising two or more legs;

one or more wheels attached to each of the two or more legs;

a support bracket disposed at an intersection of the two or more legs, the support bracket attaching an arm to the two or more legs;

a bag support disposed at a distal end of the arm;

a first brace disposed between two or more of the legs; and a second brace disposed on the first brace and connected to the arm, the second brace forming an angle with the arm.

2. The bag stand of claim 1, further comprising at least one side brace attached to one of the two or more legs, each at least one side brace comprising a main bar extending perpendicularly away from the leg.

3. The bag stand of claim 2, wherein the at least one side brace further comprises a wheel.

4. The bag stand of claim 2, wherein the at least one side brace further includes an anchor point configured to support one or more weights.

5. The bag stand of claim 1, wherein each of the one or more wheels further comprises a wheel lock configured to move between an engaged state in which the wheel lock limits movement of the respective wheel, and a disengaged state in which the wheel lock does not limit movement of the respective wheel.

6. The bag stand of claim 5, wherein the wheel lock comprises a lever configured to apply friction to the wheel when the wheel lock is in the engaged state.

7. The bag stand of claim 5, wherein each of the one or more wheels further comprises a foot, the foot being configured to contact the ground when the wheel lock is in the engaged state, and to not contact the ground when the wheel lock is in the disengaged state.

8. The bag stand of claim 1, further comprising a counterweight disposed at one side of the base, the counterweight comprising:

an anchor point;

one or more weights attached to the anchor point;

at least one spacer configured to separate the one or more weights from the base; and at least one pad configured to support the one or more weights on the at least one spacer.

9. The bag stand of claim 8, wherein the arm is angled away from the counterweight.

10. The bag stand of claim 1, wherein the support bracket further comprises a foot, the foot being configured to fit inside the arm to attach the arm to the two or more legs.

11. The bag stand of claim 1, wherein the first brace comprises a supporting tube configured to fit into and support the second brace.

12. The bag stand of claim 1, further comprising a tether strap configured to restrict the movement of a bag suspended from the bag support, such that the bag is prevented from swinging beyond a predefined point.

13. The bag stand of claim 1, further comprising a bag restraint, the bag restraint comprising a strap attached to the arm, the strap configured to secure a bag suspended from the bag support such that the bag is held against the arm.

14. The bag stand of claim 1, further comprising a speedbag attachment.

15. The bag stand of claim 1, further comprising at least one side strut disposed parallel to the arm, the at least one side strut comprising a first anchor point disposed on the arm and a second anchor point disposed on the base.

16. The bag stand of claim 1, further comprising at least one wheel lock comprising a foot, the foot being configured to contact the ground and lift the bag stand off of the one or more wheels when the at least one wheel lock is in an engaged state, and to not contact the ground when the wheel lock is in a disengaged state.

17. A bag stand, comprising:

a base comprising two or more legs, each having a first thickness;

an arm attached to at least one of the two or more legs; and at least one side brace attached to one of the legs, the at least one side brace comprising:

a main bar having a second thickness;

an upper plate attached to one face of the main bar, a first end of the upper plate extending beyond an end of the main bar;

a lower plate attached to a face of the main bar opposite the upper plate, a first end of the lower plate extending beyond the end of the main bar, wherein the first end of the upper plate and the first end of the lower plate define a distance between them equal to the first thickness, wherein the upper plate and lower plate are configured to be attached to the at least one leg, such that the main bar is perpendicular to the at least one leg and extends away from the at least one leg.

18. A bag stand, comprising:

a base comprising two or more legs;

a support bracket disposed at an intersection of the two or more legs, the support bracket attaching an arm to the two or more legs;

a bag support disposed at a distal end of the arm; and at least one side strut disposed parallel to the arm, the at least one side strut comprising a first anchor point disposed on the arm and a second anchor point disposed on the base.

19. The bag stand of claim 18, further comprising one or more wheels attached to each of the two or more legs, wherein each of the one or more wheels further comprises a wheel lock configured to move between an engaged state in which the wheel lock limits movement of the respective wheel, and a disengaged state in which the wheel lock does not limit movement of the respective wheel.

20. The bag stand of claim 19, wherein the wheel lock comprises a lever configured to apply friction to the wheel when the wheel lock is in the engaged state.

21. The bag stand of claim 19, wherein each of the one or more wheels further comprises a foot, the foot being configured to contact the ground when the wheel lock is in the engaged state, and to not contact the ground when the wheel lock is in the disengaged state.

22. The bag stand of claim 18, further comprising a counterweight disposed at one side of the base, the counterweight comprising: an anchor point; one or more weights attached to the anchor point; at least one spacer configured to separate the one or more weights from the base; and at least one pad configured to support the one or more weights on the at least one spacer.

23. The bag stand of claim 22, wherein the arm is angled away from the counterweight.

24. The bag stand of claim 18, further comprising: a first brace disposed between two or more of the legs; and a second brace disposed on the first brace and connected to the arm, the second brace forming an angle with the arm.

25. The bag stand of claim 24, wherein the first brace comprises a supporting tube configured to fit into and support the second brace.

26. The bag stand of claim 18, further comprising at least one side brace attached to one of the two or more legs, each at least one side brace comprising a main bar extending perpendicularly away from the leg.

27. The bag stand of claim 26, wherein the at least one side brace further comprises a wheel.

28. The bag stand of claim 18, wherein the support bracket further comprises a foot, the foot being configured to fit inside the arm to attach the arm to the two or more legs.

29. The bag stand of claim 18, further comprising a tether strap configured to restrict the movement of a bag suspended from the bag support, such that the bag is prevented from swinging beyond a predefined point.

30. The bag stand of claim 18, further comprising a bag restraint, the bag restraint comprising a strap attached to the arm, the strap configured to secure a bag suspended from the bag support such that the bag is held against the arm.

31. The bag stand of claim 18, further comprising a speedbag attachment.

32. A bag stand, comprising:

a base comprising two or more legs;

one or more wheels attached to each of the two or more legs, at least one of the one or more wheels comprising a wheel lock;

a support bracket disposed at an intersection of the two or more legs, the support bracket attaching an arm to the two or more legs; and a bag support disposed at a distal end of the arm, wherein the wheel lock is configured to move between an engaged state in which the wheel lock limits movement of the respective wheel, and a disengaged state in which the wheel lock does not limit movement of the respective wheel and each of the one or more wheels further comprises a foot, the foot being configured to contact the ground when the wheel lock is in the engaged state, and to not contact the ground when the wheel lock is in the disengaged state.

33. The bag stand of claim 32, further comprising a counterweight disposed at one side of the base, the counterweight comprising: an anchor point; one or more weights attached to the anchor point; at least one spacer configured to separate the one or more weights from the base; and at least one pad configured to support the one or more weights on the at least one spacer.

34. The bag stand of claim 33, wherein the arm is angled away from the counterweight.

35. The bag stand of claim 32, further comprising at least one side brace attached to one of the two or more legs, each at least one side brace comprising a main bar extending perpendicularly away from the leg.

36. The bag stand of claim 35, wherein the at least one side brace further comprises a wheel.

37. The bag stand of claim 32, wherein the support bracket further comprises a foot, the foot being configured to fit inside the arm to attach the arm to the two or more legs.

38. The bag stand of claim 32, further comprising:

a first brace disposed between two or more of the legs; and a second brace disposed on the first brace and connected to the arm, the second brace forming an angle with the arm, wherein the first brace comprises a supporting tube configured to fit into and support the second brace.

39. The bag stand of claim 32, further comprising a tether strap configured to restrict the movement of a bag suspended from the bag support, such that the bag is prevented from swinging beyond a predefined point.

40. The bag stand of claim 32, further comprising a bag restraint, the bag restraint comprising a strap attached to the arm, the strap configured to secure a bag suspended from the bag support such that the bag is held against the arm.

41. The bag stand of claim 32, further comprising a speedbag attachment.

42. The bag stand of claim 32, further comprising at least one side strut disposed parallel to the arm, the at least one side strut comprising a first anchor point disposed on the arm and a second anchor point disposed on the base.

* * * * *